US005500319A

United States Patent [19]

Funato et al.

[11] Patent Number: 5,500,319

[45] Date of Patent: Mar. 19, 1996

[54] TONER FOR A TWO-COMPONENT-TYPE MAGNETIC DEVELOPING AGENT HAVING EXCELLENT SPENT RESISTANCE

[75] Inventors: Masatomi Funato; Yoshitake Shimizu; Seijiro Ishimaru; Kazuya Nagao, all of Osaka, Japan

[73] Assignee: Mita Industrial Co., Ltd., Osaka, Japan

[21] Appl. No.: 292,026

[22] Filed: Aug. 18, 1994

[30] Foreign Application Priority Data

Aug. 19, 1993 [JP] Japan ..... 5-205182

[51] Int. Cl.$^6$ ..... G03G 9/083; G03G 9/107

[52] U.S. Cl. ..... 430/106.6; 430/108

[58] Field of Search ..... 430/106, 106.6, 430/110, 108

[56] References Cited

U.S. PATENT DOCUMENTS 4,960,669 10/1990 Mori et al. ..... 430/137
5,328,795 7/1994 Yamashiro et al. ..... 430/111
5,382,624 1/1995 Hotta et al. ..... 430/109

FOREIGN PATENT DOCUMENTS 0317667 5/1989 European Pat. Off. .
0407604 1/1991 European Pat. Off. .
0432946 6/1991 European Pat. Off. .
0470840 2/1992 European Pat. Off. .

*Primary Examiner*—John Goodrow
*Attorney, Agent, or Firm*—Sherman and Shalloway

[57] ABSTRACT

A negatively charged toner for a two-component-type magnetic developing agent, wherein a resin medium for fixing is a copolymer resin or a resin composition having anionic polar groups and contains a magnetic powder in an amount of from 0.1 to 5 parts by weight per 100 parts by weight of the resin medium, but contains no charge control agent. The toner without containing the charge control agent exhibits very excellent spent resistance.

21 Claims, 8 Drawing Sheets

TONER FOR A TWO-COMPONENT-TYPE MAGNETIC DEVELOPING AGENT HAVING EXCELLENT SPENT RESISTANCE

BACKGROUND OF THE INVENTION

1. Field of the Invention

The present invention relates to a toner for a two-component-type magnetic developing agent having excellent spent resistance. More specifically, the invention relates to a toner which contains no charge control agent, does not scatter during the developing, enables the image to be efficiently transferred, makes it possible to form image of a high density, and helps extend the life of the toner and the carrier.

2. Description of Prior Art

A so-called two-component-type magnetic developing agent has been extensively used for developing electrostatic charge image formed on an electrophotosensitive material.

The two-component-type magnetic developing agent comprises a composition of a magnetic carrier of an iron powder or ferrite particles and an electroscopic toner composed of a coloring resin composition. To carry out the developing, the magnetic carrier and the toner are mixed together to electrically charge the toner particles to a predetermined polarity, the mixture is carried to the photosensitive material in the form of a magnetic brush, the surface of the photosensitive material is rubbed by the magnetic brush, and the electrically charged toner is adsorbed and held by the charge image on the surface of the photosensitive material to form a visible image.

A charge control agent is usually contained in the toner particles in order to control the polarity of the toner gains by frictional charging. A negative charge control agent such as a metal-containing complex salt dyestuff or a metal complex of oxycarboxylic acid is used for the negatively-charged toner (e.g., see Japanese Laid-Open Patent Publication No. 67268/1991), and a positive charge control agent such as an oil-soluble dyestuff like Nigrosine or an amine control agent is used for the positively-charged toner (e.g., see Japanese Laid-Open Patent Publication No. 106249/1981).

It has long been known to use a magnetic toner as a toner for the two-component-type magnetic developing agent. For instance, the above Japanese Laid-Open Patent Publication No. 106249/1981 and Japanese Laid-Open Patent Publication No. 162563/1984 disclose a magnetic powder-containing toner which contains a magnetic powder therein. The above Japanese Laid-Open Patent Publication No. 67268/1991 discloses a magnetic powder-carrying toner obtained by adding and mixing a silica powder and a magnetic powder to the toner.

It has been known that the two-component-type magnetic developing agent exhibits satisfactory electrically charging performance in an initial state of when the magnetic carrier and the toner are used being mixed together but loses its charging performance due to the formation of a so-called spent (toner) and its life is shortened.

The spent (toner) is a phenomenon in which the toner component adheres and precipitates like a film on the surface of the magnetic carrier. Since the surface of the magnetic carrier becomes close to that of the toner, the tribo-charging series approach each other making it difficult to obtain a desired charging performance. When the spent is formed, therefore, the magnetic carrier must be replaced by a new one.

SUMMARY OF THE INVENTION

It is therefore an object of the present invention to provide a two-component-type magnetic developing agent which has excellent spent resistance and enables the toner and the carrier to extend their life.

Another object of the present invention is to provide a toner for a (CCA-less) two-component-type magnetic developing agent, which does not contain a migratory charge control agent in the toner particles, which is capable of increasing the apparent developing sensitivity without permitting the toner to scatter during the developing despite there-is contained no CCA (charge control agent).

A further object of the present invention is to provide a CCA-less two-component-type magnetic developing agent which enables the image to be efficiently transferred from the surface of the photosensitive material onto a paper despite there is contained no migratory charge control agent.

According to the present invention, there is provided a negatively-charged toner for a two-component-type magnetic developing agent having excellent spent resistance, wherein a resin medium for fixing is a copolymer resin or a resin composition having anionic polar groups and contains a magnetic powder in an amount of from 0.1 to 5 parts by weight per 100 parts by weight of said resin medium, and wherein an extract from which said toner is extracted with methanol exhibits absorbancies which are substantially zero at absorption peaks over wavelengths of from 400 to 700 nm and from 280 to 350 nm.

According to the present invention, furthermore, there is provided a toner for a two-component-type developing agent having excellent spent resistance and transfer efficiency by adhering a fine powdery fluidity-improving agent onto the surfaces of the toner particles having mean particle sizes of from 5 to 15 μm on the basis of volume, said fine powdery fluidity-improving agent containing spacer particles having mean particle sizes of from 0.05 to 1.0 μm on the basis of volume.

DETAILED DESCRIPTION OF THE INVENTION

Figure 1:
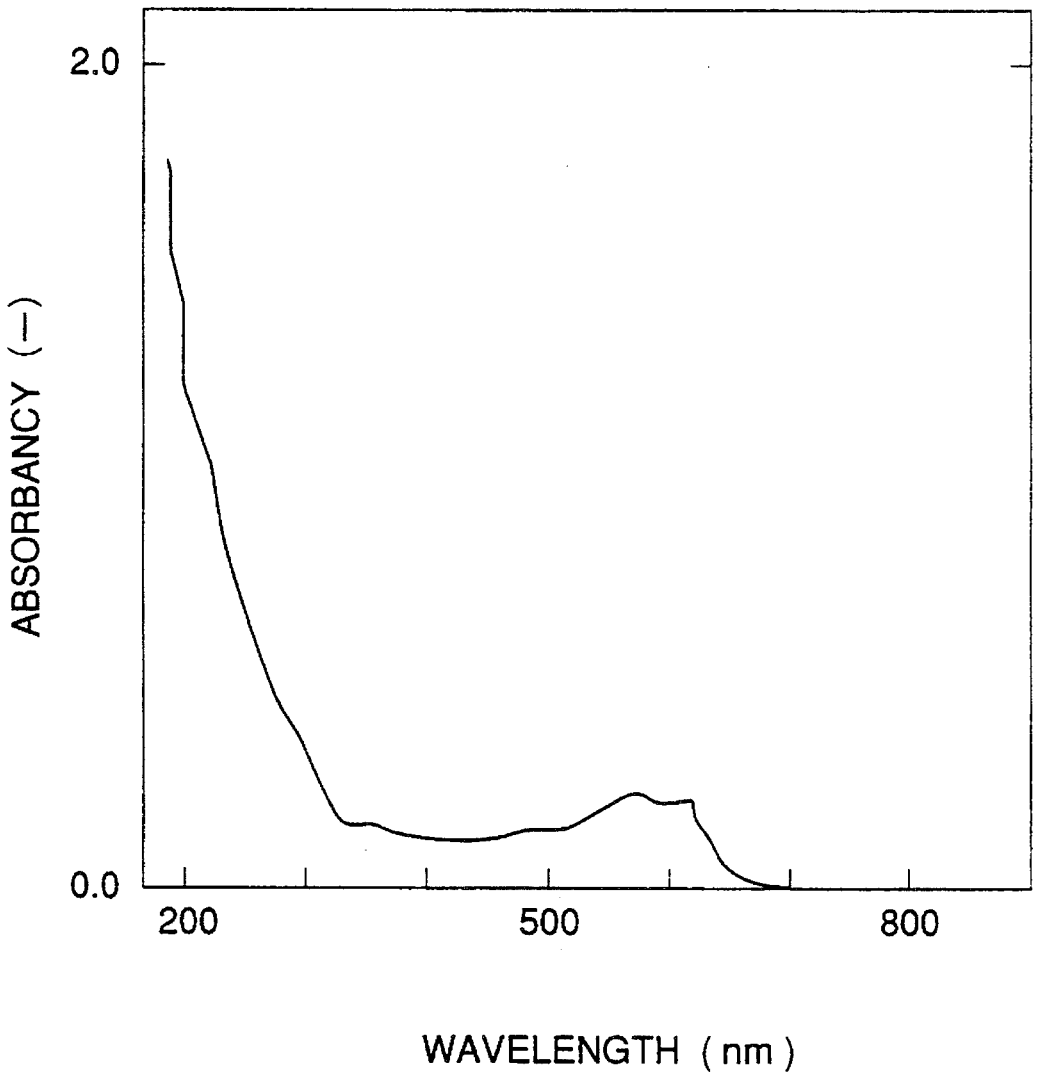
FIG. 1 is a graph showing a curve of absorbancies at wavelengths 400 to 700 nm of an extract from which a toner containing a chrome complex dyestuff (2:1 type) as a charge control agent is extracted with methanol.
Figure 2:
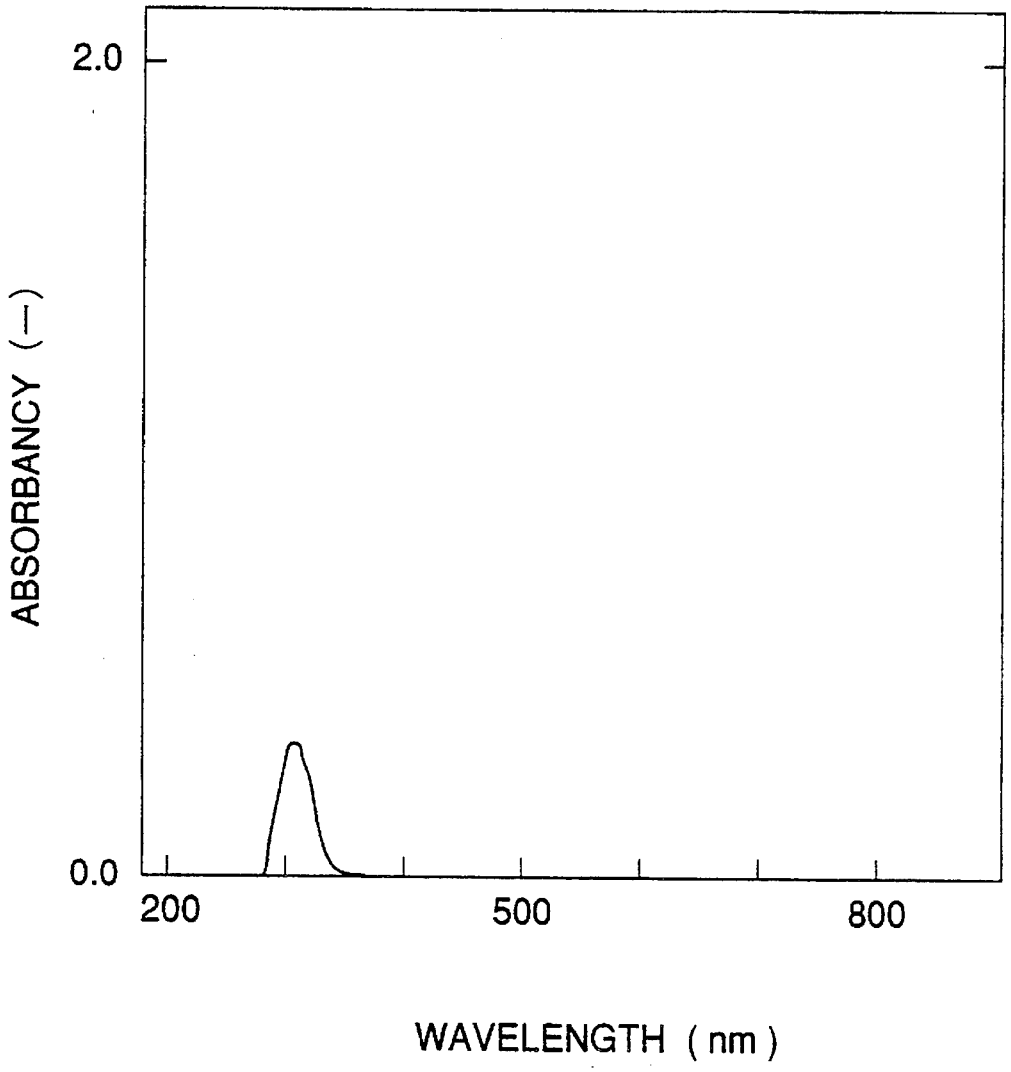
FIG. 2 is a graph showing a curve of absorbancies at wavelengths 280 to 350 nm of an extract from which a toner using a metal salicylate complex as a charge control agent is extracted with methanol.

In the accompanying drawings, FIG. 1 is a graph showing a curve of absorbancies at wavelengths 400 to 700 nm of an extract from which a toner containing a chrome complex dyestuff (2:1 type) as a charge control agent is extracted with methanol among the conventional toners for the two-component-type magnetic developing agents used for developing positively charged image, and FIG. 2 is a graph showing a curve of absorbancies at wavelengths 280 to 350 nm of an extract from which a toner using a metal salicylate complex as a charge control agent is extracted with methanol.

From these results, the above two extracts exhibit characteristic absorption peaks based upon the charge control agents, meaning that the charge control agents are adhered to the surfaces of the toner particles at considerably high concentrations. This fact matches well with an idea that the charge control agent contained inside the toner migrates onto the surfaces of the toner particles, and the electric charge due to the frictional charging is controlled by the migration of the charge control agent.

Figure 3:
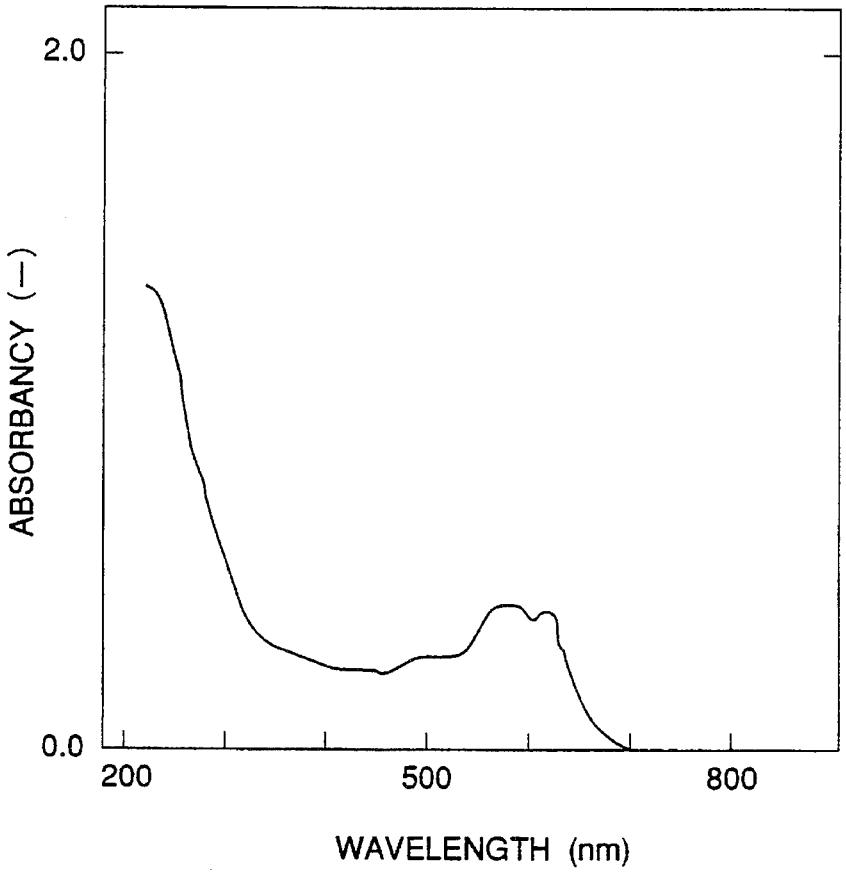
FIG. 3 is a graph showing a curve of absorbancies at wavelengths 400 to 700 nm of an extract of when the toner used in the measurement of FIG. 1 is used as a two-component-type magnetic developing agent, and is extracted with methanol for those carriers that have developed poor charging due to the spent.

FIG. 3 is a graph showing a curve of absorbancies at wavelengths 400 to 700 nm of an extract of when the toner used in the measurement of FIG. 1 is used as a two-component-type magnetic developing agent, and is extracted with methanol for those carriers that have developed poor charging due to the spent.

According to the above results of measurement, the charge control agent is adhered and precipitated at a high concentration even on the surfaces of the carrier, revealing an astonishing fact that poor charging due to the spent is not a simple filming on the carrier surfaces due to the toner resin that was so far considered but is the migration of the charge control agent onto the surfaces of the carrier.

Figure 4:
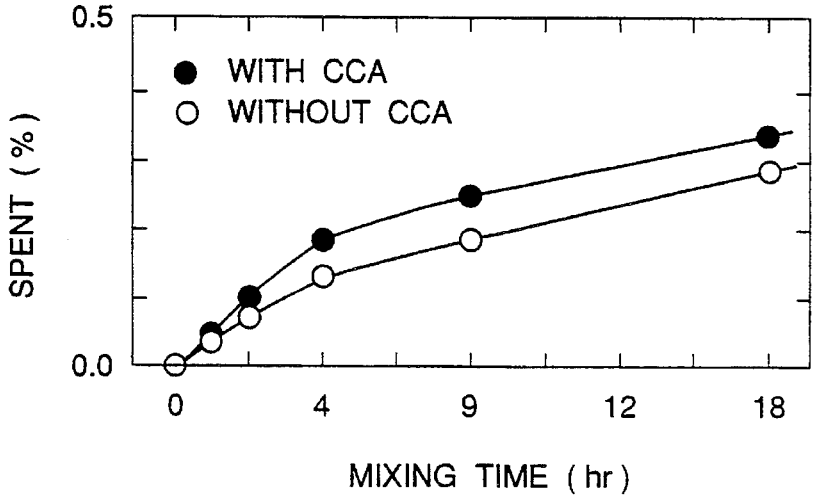
FIG. 4 is a graph plotting relationships between the mixing time and the amount of spent of when a mixture of a toner containing a charge control agent and a magnetic carrier as well as a mixture of a toner without containing charge control agent and the magnetic carrier, are mixed.
Figure 5:
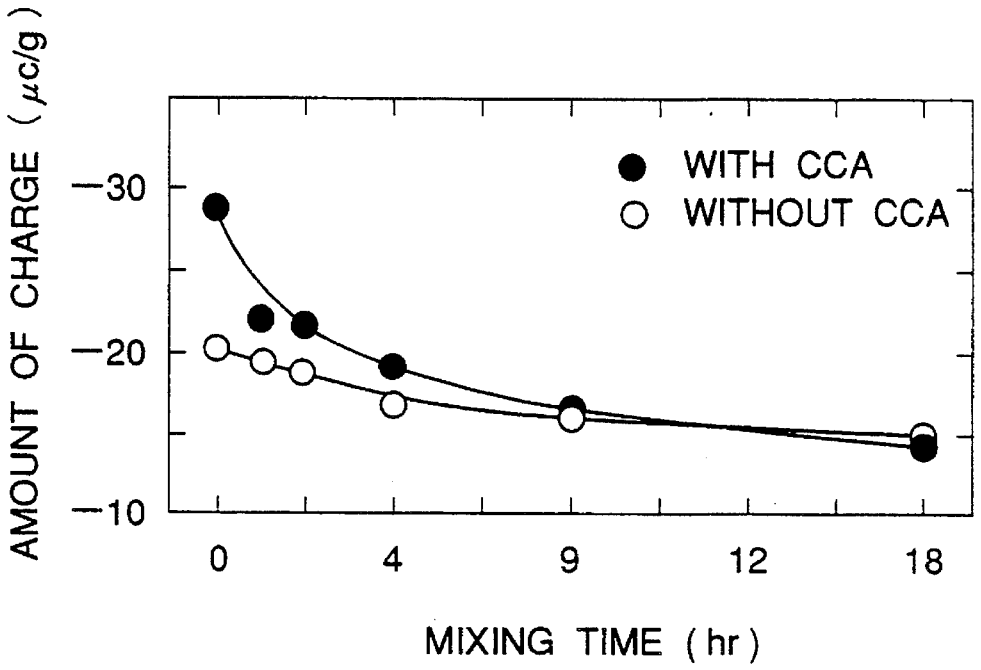
FIG. 5 is a graph plotting relationships between the mixing time and the amount of charge of when a mixture of a toner containing a charge control agent and a magnetic carrier as well as a mixture of a toner without containing charge control agent and the magnetic carrier, are mixed.

This fact will become more apparent from FIGS. 4 and 5 which are graphs plotting relationships between the mixing time and the amount of spent and relationships between the mixing time and the amount of charge of when a mixture of a toner containing a charge control agent and a magnetic carrier as well as a mixture of a toner without containing charge control agent and the magnetic carrier, are mixed. From these results, a fact becomes obvious that the toner containing the charge control agent gives an increased amount of spent and a decreased amount of charge compared with the toner without containing the charge control agent.

Figure 6:
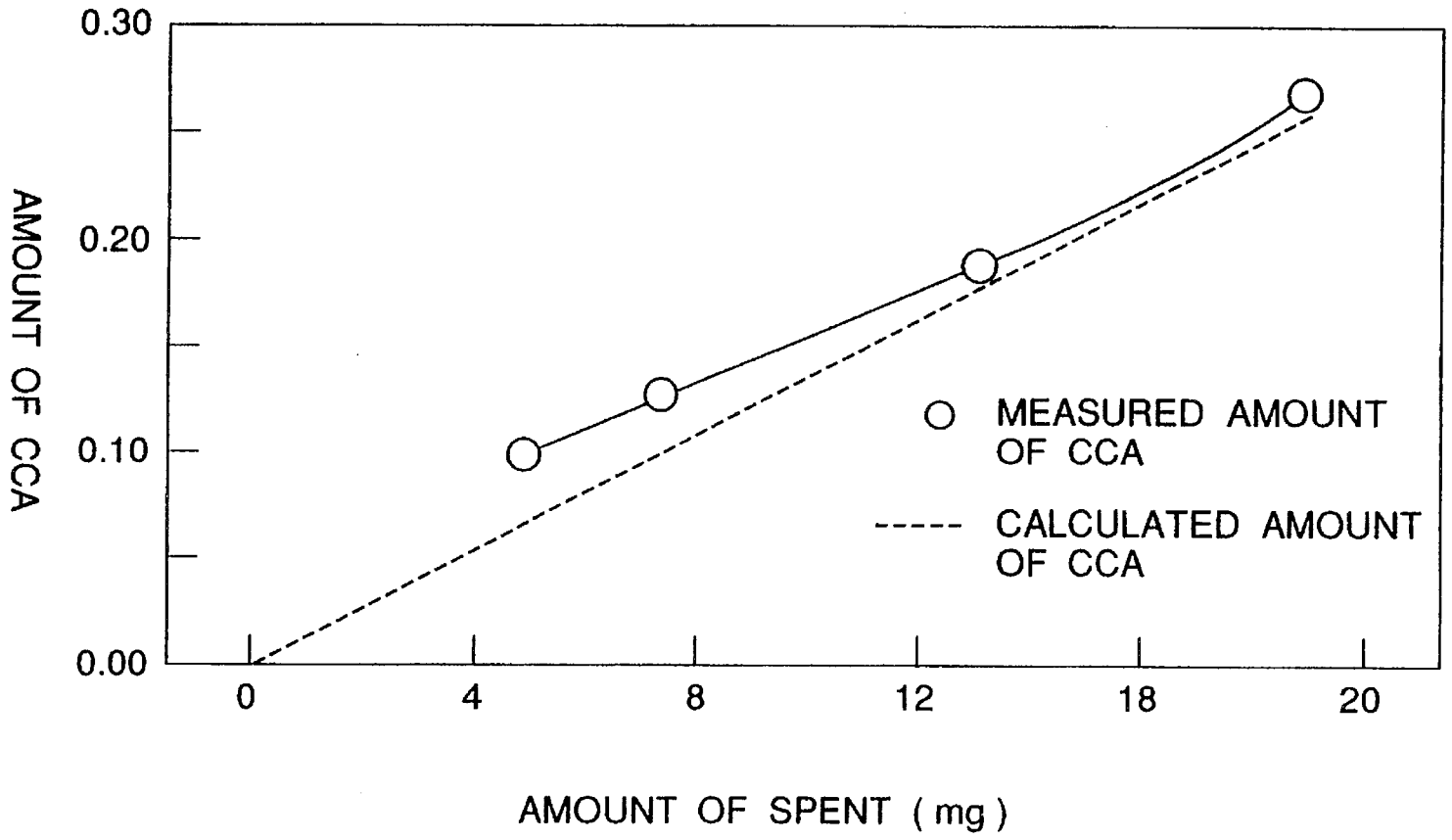
FIG. 6 is a graph measuring a relationship between the amount of spent of the carrier to which the spent has adhered and the charge control agent in the spent toner.

FIG. 6 is a graph measuring a relationship between the amount of spent of the carrier to which the spent has adhered and the charge control agent in the spent toner, and wherein a dotted line is drawn by plotting values calculated from the toner recipe. It becomes obvious from the results of FIGS. 5 and 6 that the charge control agent is selectively migrating and is adhering onto the surfaces of the carrier in the initial stage where the spent is taking place. The results of FIGS. 5 and 6 are those of a closed system where no toner is replenished. When the toner is renewed in a copying machine, it is expected that the difference will further increase depending upon the presence or absence of the charge control agent.

Figure 7:
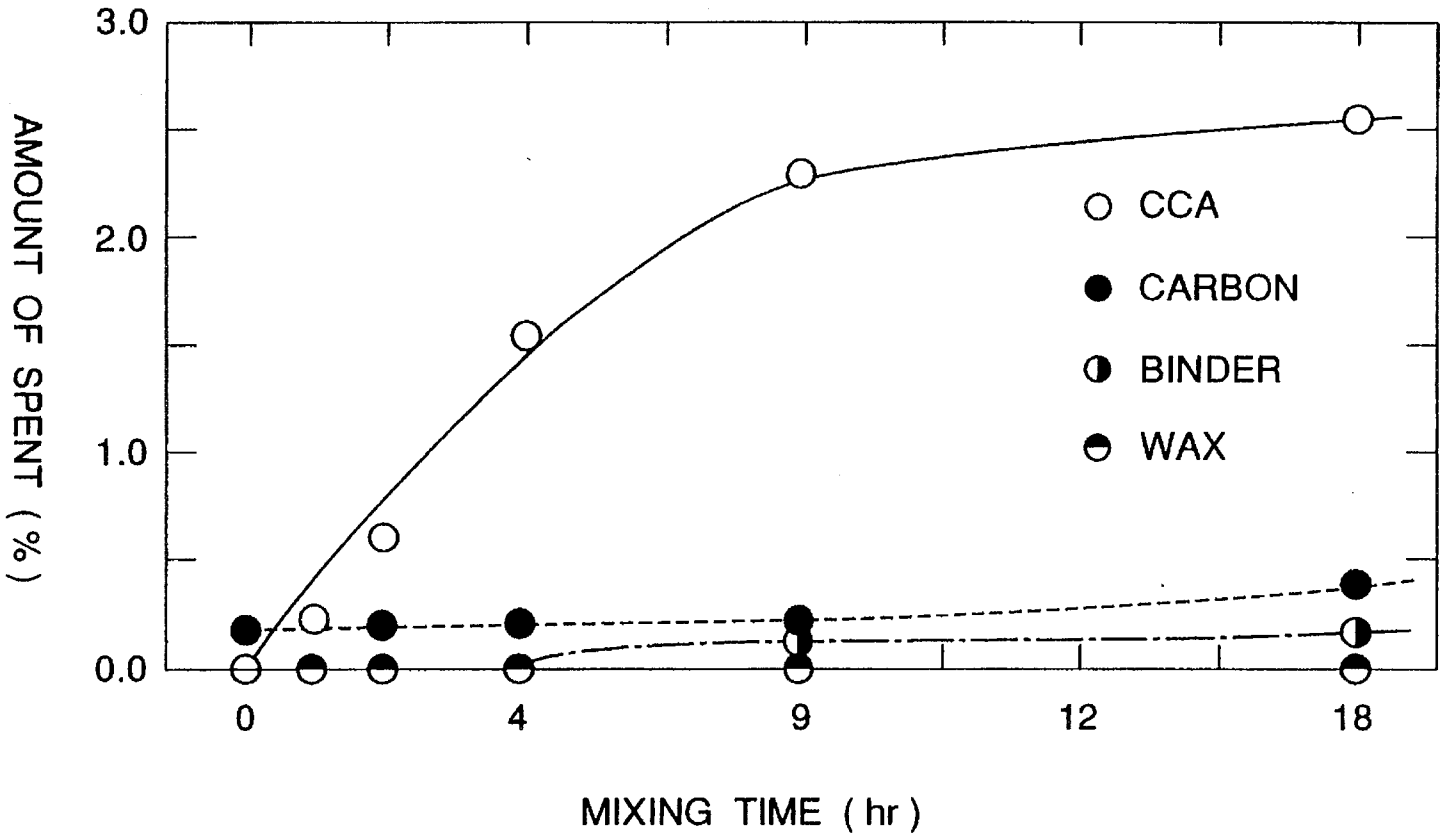
FIG. 7 is a graph illustrating relationships between the mixing time and the amount of spent of when each of the components in the toner and the magnetic carrier are mixed.

FIG. 7 is a graph illustrating relationships between the mixing time and the amount of spent of when each of the components in the toner and the magnetic carrier are mixed. These results clarify a fact that among many components in the toner,-the charge control agent overwhelmingly migrate toward the surfaces of the carrier giving rise to the formation of spent.

Figure 8:
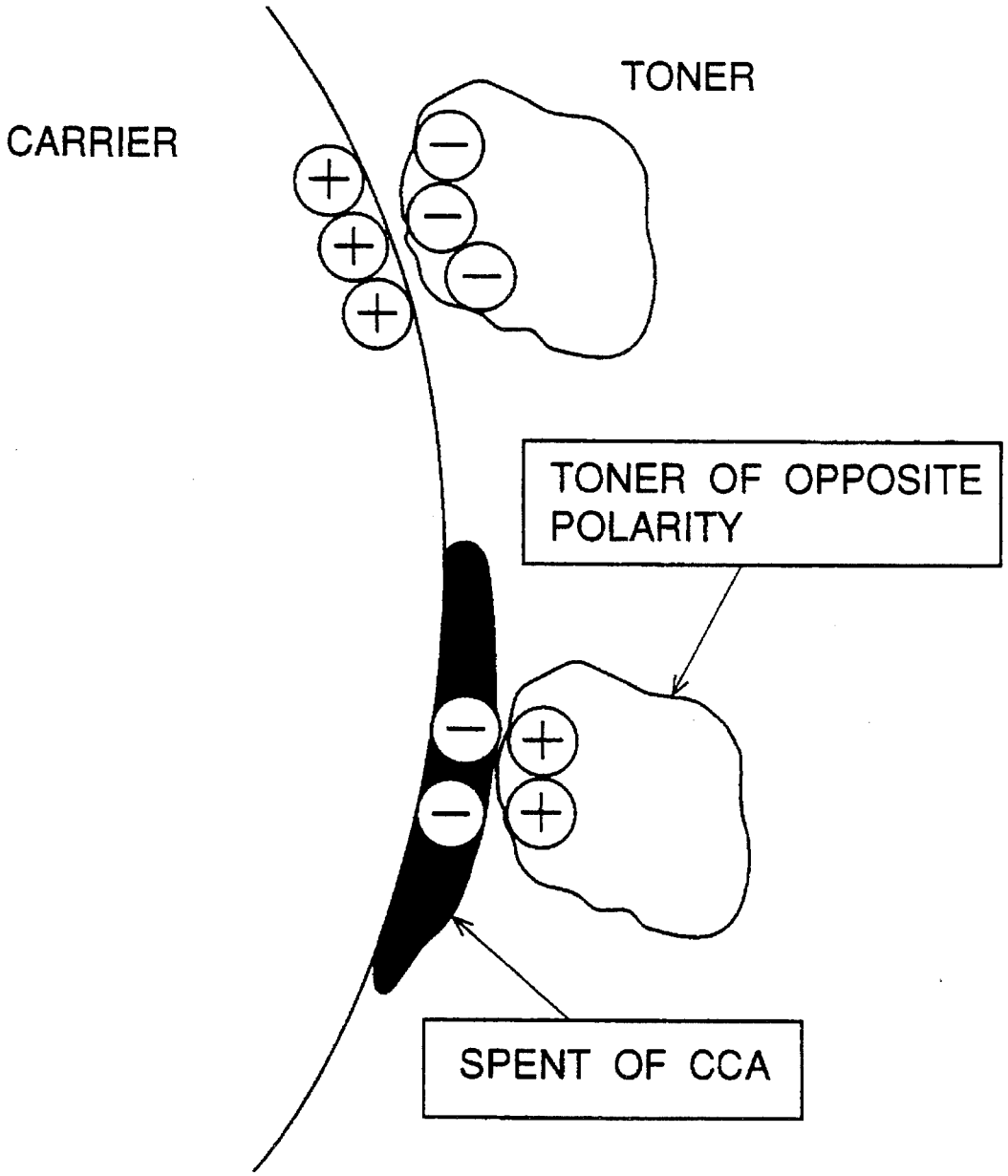
FIG. 8 is a diagram illustrating the occurrence of poor charging due to the formation of the spent using a conventional two-component-type magnetic developing agent.

From the foregoing as illustrated in the diagram of FIG. 8, it can be explained that the poor charging of the conventional two-component-type magnetic developing agent due to the formation of spent stems from the fact that in the initial stage in which the mixture is used, the carrier is positively charged and the toner is negatively charged but as the charge control agent selectively migrates onto the surfaces of the carrier to form the spent, then the spent layer is negatively charged, causing the toner to be positively charged.

Figure 9:
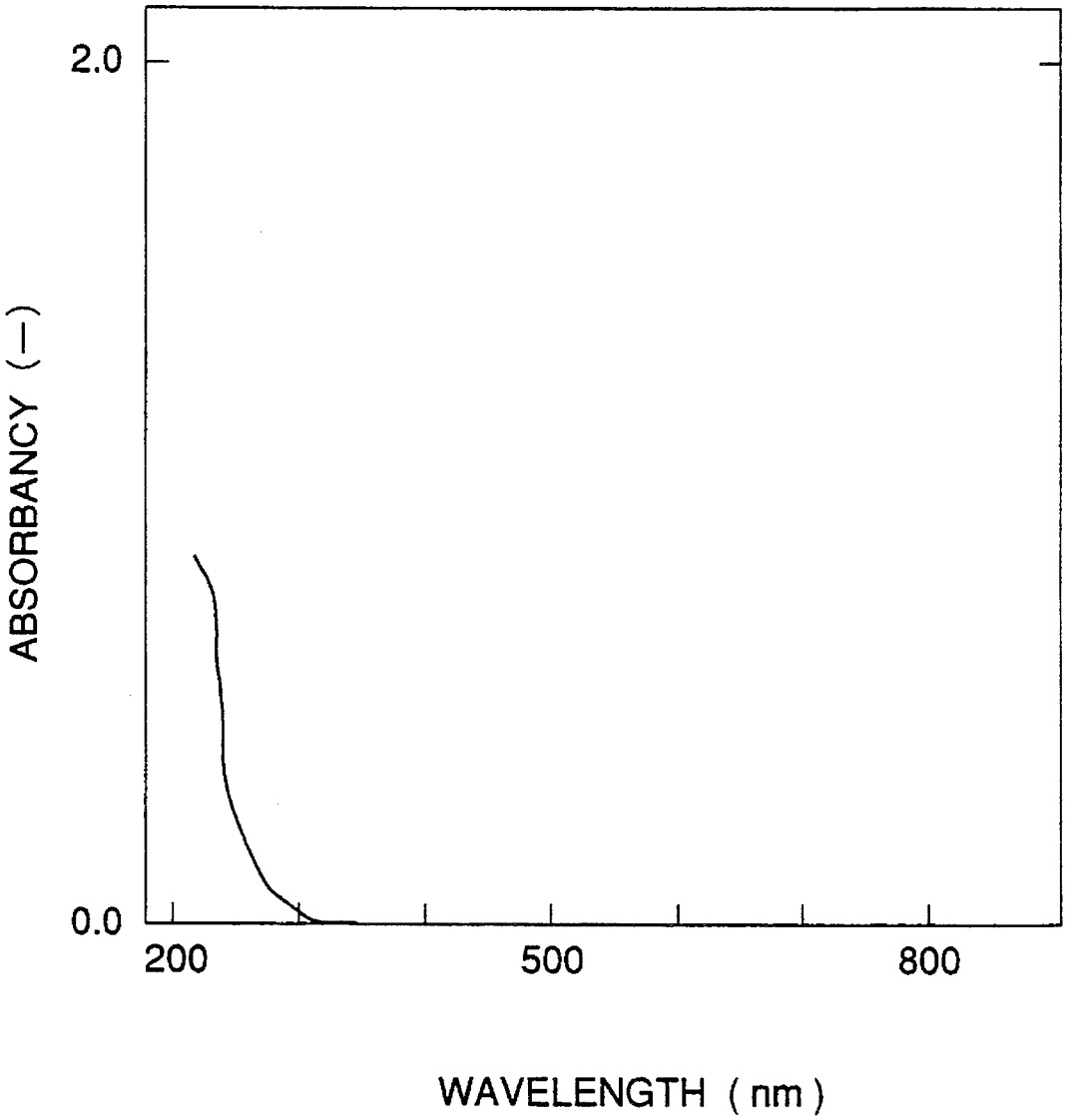
FIG. 9 is a graph showing a curve of absorbancies at wavelengths 400 to 700 nm (at wavelengths 280 to 350 nm) of an extract of the present invention from which the toner is extracted with methanol.

In order to prevent the charge control agent from migrating onto the surfaces of the magnetic carrier, the toner particles according to the present invention do not contain or are not blended with the migratory charge control agent. When the toner of the present invention is extracted with methanol as represented by a curve of absorbancies of FIG. 9, therefore, the methanol extract exhibits no absorption peak over a wavelength region of from 400 to 700 nm or exhibits absorbancy which is substantially zero if it exists. As represented by the curve of absorbancies of FIG. 9, furthermore, measurement of absorbancy of the extract over a wavelength region of from 280 to 350 nm exhibits no absorption peak, and the absorbancy is substantially zero. Therefore, the charge control agent is suppressed from migrating onto the surfaces of the carrier and the spent resistance is improved, creating a first feature of the present invention.

Here, as shown in FIG. 5, the toner without containing the charge control agent has the amount of charge which is smaller than that of the toner blended with the charge control agent. To overcome this defect, the present invention uses, as a resin medium for fixing, a copolymer resin or a resin composition having anionic polar groups. Use of the resin or the resin composition makes it possible to obtain a property for controlling the electric charge of frictional charging that is at least required for the developing.

The anionic polar group gives charge control property to the toner. The anionic polar group that is bonded to the skeleton of resin does not migrate onto the surfaces of the toner particles but provides weak coulomb force for bonding the toner particles in the magnetic brush to the carrier during the developing. Therefore, the toner scatters conspicuously as the copying speed increases, and the copying machine is contaminated with the toner and the fogging density increases in the obtained copies.

In order to prevent this defect according to the present invention, the toner contains a magnetic powder in a particular amount to obtain magnetic attractive force between the toner and the carrier in addition to the coulomb force between the toner and the carrier, so that the toner is prevented from scattering.

According to the present invention, the apparent sensitivity is increased during the developing while preventing the toner from scattering, creating one of the distinguished merits of the invention. That is, the smaller the amount of electric charge per one toner particle, the larger the number of toner particles adhering to the electrostatic latent image of a predetermined amount of electric charge, and the apparent developing sensitivity increases.

According to the present invention, a distinguished advantage resides in the formation of image of a high density while preventing the toner from scattering by internally adding a magnetic powder in an amount of as small as from 0.1 to 5 parts by weight and, particularly, 0.5 to 3.0 parts by weight per 100 parts by weight of the resin medium. With the magnetic toner used for the conventional two-component-type magnetic developing agent, the magnetic powder must be used in an amount larger than 10 parts by weight per 100 parts by weight of the resin medium. According to the present invention, however, the magnetic powder is used in an amount far smaller than the above amount.

When the magnetic powder is used in an amount which is smaller than 0.1 part by weight, the toner easily scatters and when it is used in an amount larger than 5 parts by weight, on the other hand, the developing density decreases.

According to the present invention, the toner usually has a mean particle size of from 5 to 15 μm. Here, it is desired to adhere by external addition a fine powdery fluidity-improving agent containing spacer particles of sizes of from 0.05 to 1.0 μm onto the surfaces of the toner particles.

In general, in order to improve the powdery fluidity, a fluidity-improving agent such as fine granular silica or the like is adhered to the toner by external addition. According to the present invention, however, spacer gains of sizes of from 0.05 to 1.0 μm are contained in the fluidity-improving agent to weaken the bond between the toner image and the latent image on the surface of the photosensitive material, so that the toner image is easily peeled off, making it possible to improve the transfer efficiency in the step of transferring the toner image.

[Resin Medium]

The resin medium for fixing used in the present invention is a copolymer resin or a resin composition having anionic polar groups. The anionic polar group may be any polar group such as carboxylic acid, sulfonic acid or phosphonic acid. However, a particularly preferred example is a polar group of the type of carboxylic acid. The copolymer resin having anionic polar group is obtained by incorporating a monomer having an anionic polar group into a resin by the random copolymerization, block copolymerization or graft copolymerization. Suitable examples of the comonomer are as follows:

Those of the carboxylic acid type include an ethylenically unsaturated carboxylic acid such as acrylic acid; methacrylic acid; crotonic acid; maleic acid, maleic anhydride, fumaric acid; a lower alkyl half ester such as maleic acid or fumaric acid; and the like.

Those of the sulfonic acid type include a styrene sulfonate, a 2-acrylamide-2-methylpropane sulfonate, and the like.

Those of the phosphonic acid type include a 2-acid phosphoxypropyl methacrylate, a 2-acid phosphoxyethyl methacrylate, a 3-chloro-2-acid phosphoxypropyl methacrylate, and the like.

The unit of these anionic polar group-containing monomer may be a free acid or may be neutralized with an alkali metal such as sodium or potassium, or with an alkaline earth metal such as calcium or magnesium, or with zinc.

Another monomer which is a chief component of the resin or the resin composition should exhibit, when it is polymerized, a fixing property and an electroscopic property required for the toner. One kind of monomer or two or more kinds of monomers having an ethylenically unsaturated bond are used in combination.

Suitable examples of the monomer include an acrylic monomer, a monovinyl aromatic monomer, a vinyl ester monomer, a vinyl ether monomer, a diolefin monomer and a monoolefin monomer.

The acrylic monomer will be the one represented by, for example, the following formula (1), $$CH{=}\overset{\overset{R_1}{|}}{C}{-}COOR_2 \qquad (1)$$

wherein $R_1$ is a hydrogen atom or a lower alkyl group, $R_2$ is a hydrogen atom, a hydrocarbon group with up to 12 carbon atoms, or a hydroxyalkyl group, such as methyl acrylate, ethyl acrylate, butyl acrylate, 2-ethylhexyl acrylate, cyclohexyl acrylate, phenyl acrylate, methyl methacrylate, hexyl methacrylate, 2-ethylhexyl methacrylate, β-hydroxyethyl acrylate, γ-hydroxypropyl acrylate, δ-hydroxybutyl acrylate, β-hydroxyethyl methacrylate, and the like.

The monovinyl aromatic monomer will be a monovinyl aromatic hydrocarbon represented by, for example, the following formula (2), $$CH{=}\overset{\overset{R_3}{|}}{C}{-}\phi{-}R_4 \qquad (2)$$

wherein $R_3$ is a hydrogen atom, a lower alkyl group or a halogen atom, $R_4$ is a hydrogen atom, a lower alkyl group, a halogen atom, an alkoxy group, an amino group or a nitro group, and $\phi$ is a phenylene group, such as styrene, α-methylstyrene, vinyl toluene, αchlorostyrene, o-, m- or p-chlorostyrene, or p-ethyl styrene, which may be used alone or in a combination of two or more kinds.

There can be further exemplified the following monomers.

A vinyl ester of the following formula (3), $$CH{=}CH{-}OOCR_5 \qquad (3)$$

wherein $R_5$ is a hydrogen atom or a lower alkyl group, such as vinyl formate, vinyl acetate, vinyl propionate and the like.

A vinyl ether of the following formula (4), $$CH{=}CH{-}O{-}R_6 \qquad (4)$$

wherein $R_6$ is a monovalent hydrocarbon group with up to 12 carbon atoms, such as vinyl methyl ether, vinyl ethyl ether, vinyl-n-butyl ether, vinyl phenyl ether, vinyl cyclohexyl ether, and the like.

Diolefins of the following formula (5), $$CH{=}\overset{\overset{R_7}{|}}{C}{-}\overset{\overset{R_8}{|}}{C}{=}C{-}R_9 \qquad (5)$$

wherein $R_7$, $R_8$ and $R_9$ are each a hydrogen atom, a lower alkyl group or a halogen atom, such as butadiene, isoprene, chloroprene, and the like. Monoolefins of the following formula (6)

$$CH=C(R_{10})-R_{11} \quad (6)$$

wherein $R_{10}$ and $R_{11}$ are each a hydrogen atom or a lower alkyl group, such as ethylene, propylene, isobutylene, butene-1, pentene-1, 4-methylpentene-1, and the like.

It is desired that the copolymer resin used in the present invention has anionic polar groups at a concentration of from 2 to 30, preferably from 4 to 20, and most preferably, from 5 to 15 in terms of an acid value in the case of a free acid. Even when part or whole of the anionic polar groups of the copolymer resin are neutralized, it is desired that the copolymer resin has anionic polar groups at a concentration that corresponds to the above acid value.

When the concentration of the anionic polar groups in the copolymer resin is smaller than the above-mentioned range, the charging property of the toner becomes unsatisfactory and when the concentration of the anionic polar groups is larger than the above-mentioned range, the toner becomes susceptible to humidity which is not desirable.

A preferred copolymer resin contains, as essential components, an anlonic polar group-containing monomer, and one or two or more kinds of acrylic monomers of the formula (1) and, as required, monomers of the formulas (2) to (6) as arbitrary components.

According to the present invention, the anionic polar group-containing copolymer resin can be used alone as described above. Furthermore, a composition containing two or more kinds of anionic polar group-containing copolymer resins or a composition of an anionic polar group-containing copolymer resin and a copolymer resin without having anionic polar group can be used as a resin medium for fixing.

When the resin medium for fixing comprises a resin composition, the concentration of the anionic polar group of the whole resin composition should lie within a range mentioned above with reference to the copolymer resin.

According to the present invention, the most preferred example is a styrene acrylic copolymer resin S or a resin composition having an acid value that lies within the aforementioned range.

[Magnetic Powder]

The magnetic powder to be internally added into the above-mentioned resin medium for fixing is a magnetic powder that is used for the conventional magnetic toners, such as tri-iron tetroxide ($Fe_3O_4$), iron sesquioxide ($\gamma$—$Fe_2O_3$), zinc iron oxide ($ZnFe_2O_4$), yttrium iron oxide ($Y_3Fe_5O_{12}$), cadmium iron oxide ($CdFe_2O_4$), gadolinium iron oxide ($Gd_3Fe_5O_{12}$) copper iron oxide ($CuFe_2O_4$), lead iron oxide ($PbFe_{12}O_{19}$), nickel iron oxide ($NkFe_2O_4$), neodymium iron oxide($NdFeO_3$), barium iron oxide ($BaFe_{12}O_{19}$), magnesium iron oxide ($MgFe_2O_4$), manganese iron oxide ($MnFe_2O_4$), lanthanum iron oxide ($LaFeO_3$), iron powder (Fe), cobalt powder (Co), nickel powder(Ni), or the like.

The magnetic powder that is particularly suited for the object of the present invention is a fine granular tri-iron tetroxide (magnetite). A desired magnetite has an orthooctahedral shape with a mean particle size ranging from 0.05 to 1.0 μm. The magnetite particles may have been treated for their surfaces with a silane coupling agent or a titanium coupling agent.

[Toner Composition]

The toner composition of the present invention contains the aforementioned resin medium for fixing and the magnetic powder as essential components and may further contain various other blending agents. Examples include a coloring agent, a parting agent and a fixing-improving agent.

[Coloring Agent]

Preferred examples of the coloring agent (pigment) are as described below.

Black Pigment:

Carbon black, acetylene black, lamp black and aniline black.

Yellow Pigment:

Chrome yellow, zinc yellow, cadmium yellow, yellow iron oxide, mineral fast yellow, nickel titanium yellow, naples yellow, Naphthol Yellow S, Hansa Yellow G, Hansa Yellow 10G, Benzidine Yellow G, Benzidine Yellow GR, Quinoline Yellow Lake. Permanent Yellow NCG and Tartrazine Yellow Lake.

Orange Pigment:

Chrome orange, molybdenum orange, Permanent Orange GTR, pyrazolone orange, Vulcan Orange, Indathlene Brilliant Orange RK, Benzidene Orange G, and Indathlene Brilliant Orange GK.

Red Pigment:

Red iron oxide, cadmium red, red lead, cadmium mercury sulfide, Permanent Red 4R, Lithol Red, pyrazolone red, watching red calcium salt, Lake Red D, Brilliant Carmine 6B, eosin lake, Rhodamine Lake B, Alizarine Lake, and Brilliant Carmine 3B.

Violet Pigment:

Manganese violet, Fast Violet B, and Methyl Violet Lake.

Blue Pigment:

Prussian blue, cobalt blue, Alkali Blue Lake, Victoria Blue Lake, phthalocyanine blue, metal-free phthalocyanine blue, partly chlorinated product of phthalocyanine blue, Fast Sky Blue, and Indathlene Blue BC.

Green Pigment:

Chrome green, chromium oxide, Pigment Green B, Malachite Green Lake, and Final Yellow Green G.

White Pigment:

Zinc flower, titanium oxide antimony white, and zinc sulfate.

Extender Pigment.

Barite powder, barium carbonate, clay, silica, white carbon, talc, and alumina white.

The above-mentioned pigments are usually used in amounts of from 2 to 20 parts by weight per 100 parts by weight of the resin medium for fixing.

According to the present invention, it was found that among the above-mentioned pigments, use of carbon black greatly affects the charging stability and, particularly, the transfer efficiency of the toner due to chemical and physical properties of the toner. For instance, when carbon black having a dispersion pH of 7 or smaller, a BET specific surface area of from 90 to 200 $m^2/m$ and a DBP oil-absorbing amount (oil-absorbing amount using dibutyl phthalate as a medium) of not smaller than 50 ml/100 g is contained in an amount of from 2 to 15 pares by weight and, most preferably, from 5 to 12 parts by weight per 100 parts by weight of the resin medium, a uniformly charging property is obtained even from the CCA-less toner, enabling the electric charging of the toner to be stabilized and the transfer efficiency of the toner to be enhanced.

Reference should be made to Table 1 related to Examples 1 to 8 appearing later. Carbon black usually has a dispersion pH (pH of when carbon black is dispersed in water) of 8 to 9. When this ordinary carbon black is used, however, CCA-less toner exhibits a transfer efficiency of merely about 65%. By using carbon black having a dispersion pH of smaller than 7, however, the transfer efficiency can be increased to be 80% or higher. Moreover, carbon black particles having the above pH value disperse excellently in the resin medium.

Moreover, carbon black that is used here has a BET specific surface area of as relatively small as 90 to 200 $m^2/g$ and a DBP oil-absorbing amount of as large as 50 ml/100 g, still making it possible to enhance the transfer efficiency compared with those having BET specific surface areas larger than the above-mentioned range and having DBP oil-absorbing amounts smaller than the above-mentioned range.

Physical effects of carbon black upon the charging property of the CCA-less toner are so complex that their mechanisms have not yet been clarified, but it is certain that the surface state of carbon black particles and the structure in which carbon black particles are linked together are playing important roles upon the charging property of the toner particles.

Furnace black can be advantageously used for satisfying the above-mentioned conditions. Carbon black having a pH of smaller than 7 has an acidic group (e.g., carboxyl group) on the particle surfaces thereof; i.e., carbon black having a pH of smaller than 7 can be obtained by subjecting ordinary carbon black (pH is not smaller than 7) to the chemical treatment such as treatment with acid or to the acid-addition treatment. Examples of acid that can be used for these treatments include an inorganic acid such as hydrochloric acid, sulfuric acid, nitric acid or phosphoric acid, and organic acid such as acetic acid, citric acid, propionic acid, benzoic acid, salicylic acid or toluenesulfonic acid. The acid is used in such a small amount that the dispersion pH does not exceed 7, and electric properties of the toner are not adversely affected.

[Parting Agent]

A variety of waxes and low molecular olefin resins can be used as a parting agent for thermal fixing to prevent offset.

Olefin resins may be polypropylene, polyethylene, and propylene-ethylene copolymer. Among them, polypropylene is preferably used.

The above-mentioned parting agent can be blended in an amount of from 0.1 to 6 parts by weight per 100 parts by weight of the resin medium for fixing.

[Fixing-Improving Agent]

According to the present invention, furthermore, it is allowed to use a polyester resin having a weight average molecular weight of 500 to 10,000 or a polyethylene resin having a number average molecular weight of 1000 to 5000 as an agent for improving the fixing property of the toner.

That is, the present invention uses a resin medium for fixing having anionic polar groups. The polar groups, however, exist on side chains or at terminals of high molecules constituting the resin; i.e., the polar groups may undergo crosslinking (hydrogen bond due chiefly to a hydroxyl group) resulting in an increase in the bondability of the resin and an increase in the heat-melting temperature, that is detrimental to the fixing. The polyester resin and the polyethylene resin having molecular weights over the above-mentioned ranges have such properties that their softening points are relatively low. By blending these resins in the resin medium for fixing, it is allowed to improve the fixing property of the toner and to effectively suppress the scattering of toner.

The polyester resin that is used as the fixing property-improving agent should be blended usually in an amount of from 0.5 to 20 parts by weight and, particularly, from 1 to 10 parts by weight per 100 parts by weight of the resin medium for fixing. The polyethylene resin that is used as the fixing property-improving agent should be blended in an amount of from 0.5 to 5 parts by weight and, particularly, from 0.5 to 3 parts by weight.

Concrete examples of the polyester resin are those synthesized from a diol component such as glycol, bisphenol-type diol or the like, and a dicarboxylic acid component comprising aliphatic dicarboxylic acid, phthalic acid, isophthalic acid, terephthalic acid and acid anhydride thereof. The polyester resin, however, is in no way limited thereto only so far as the molecular weight lies within the aforementioned range.

As the polyethylene resin, there can be exemplified low-density and/or high-density polyethylenes which are used as a parting agent from the fixing roller, i.e., used as an offset-preventing agent.

[Preparation of Toner]

The toner of the present invention can be prepared by any widely known method such as a pulverization/classification method, a melt granulating method, a spray granulating method or a polymerization method. Among them, the pulverization/classification method is generally used.

The above-mentioned toner components are pre-mixed using a mixing machine such as Henschel's mixer, kneaded together using a kneading machine such as a biaxial extruder, and the kneaded composition is cooled, pulverized and is classified to obtain the toner.

The toner should have a mean particle size, i.e., a median diameter of from 5 to 15 μm and, particularly from 7 to 12 μm as measured by using a Couter counter.

[Externally Added Agent]

As required, a fluidity-improving agent such as a hydrophobic gas-phase silica or the like can be adhered to the surfaces of the toner particles to improve the fluidity of the toner. The fluidity-improving agent should be added in an amount of 0.1 to 2.0% by weight with respect to the toner.

According to a preferred embodiment of the present invention, the fluidity improving agent further contains spacer particles of mean particle sizes of from 0.05 to 1.0 μm which are larger than the mean particle sizes of the fluidity-improving agent to improve the transfer efficiency.

Any organic or inorganic inert regular particles can be used as the spacer grains provided their mean particle sizes lie within the above-mentioned range. In general, however, it is desired to use zinc oxide and the above-mentioned magnetic powder and, particularly, the fine granular tri-iron tetroxide(magnetite). This is because, the magnetic powder that exists being adhered to the surfaces of the toner particles effectively works against the scattering of the toner.

It is desired that the spacer particles such as of fine granular tri-ion tetroxide (magnetite), zinc oxide or the like are externally added in an amount of from 0.1 to 10% by weight with respect to the toner.

The magnetic powder used as the spacer particles can be used alone to effectively suppress the scattering of toner. When the magnetic powder is used alone, its amount should be such that the total amount together with the magnetic powder that has been contained therein is 8 parts by weight or less per 100 parts by weight of the resin medium for fixing. In particular, the amount of the magnetic powder that is added alone should be from 0.3 to 1.5 parts by weight.

In externally adding the fluidity-improving agent and the spacer particles to the toner, it is desired that the fluidity-improving agent and the spacer particles are intimately mixed together under the pulverizing conditions, and this mixture is added to the toner followed by pulverization to a sufficient degree.

[Magnetic Carrier]

According to the present invention, the toner is mixed into the magnetic carrier so as to be used as a two-component-type developing agent. The mixing ratio of the magnetic carrier to the toner should be usually from 98:2 to 90:10 on the weight basis and, particularly, from 97:3 to 92:8 on the weight basis.

The magnetic carrier will be a widely known one, such as an iron powder carrier or a ferrite carrier having a saturation magnetization of from 30 to 70 emu/g and, particularly, from 40 to 60 emu/g, and a mean particle size of from 20 to 140 μm and, particularly, from 50 to 100 μm. Among them, particularly useful examples are a ferrite magnetic carrier and, particularly, a soft ferrite containing at least one or, preferably, two or more of metal components selected from the group consisting of Cu, Zn, Mg, Mn and Ni, such as sintered ferrite spherical particles of a copper-zinc-magnesium ferrite. The surfaces of the magnetic carrier may not be coated but are usually coated with a silicone resin, a fluorine-containing resin, an epoxy resin, an amino resin or an urethane resin.

The toner of the present invention is capable of forming favorable image even when the above-mentioned conventional magnetic carrier is used. Desirably, however, the toner of the invention can be used in combination with the magnetic powder dispersion-type carrier.

Magnetic Powder Dispersion-Type Carrier

The magnetic carrier is obtained by dispersing a high-resistance magnetic powder having a resistivity of not smaller than $1\times10^5$ Ω-cm and, particularly, $10^6$ to $10^7$ Ω-cm in a thermoplastic resin or a resin composition having a cationic polar group, the content of the high-resistance magnetic powder being from 60 to 88% by weight and, particularly, from 70 to 85% by weight per the whole amount. The mean particle sizes are from 50 to 150 μm and, particularly, from 70 to 120 μm; i.e., the particles have large sizes without containing fine particles.

The magnetic powder dispersion-type carrier has a cationic polar group in the resin which is a dispersion medium, and tends to be positively charged with respect to the CCA-less toner which is negatively charged. When used in combination with the toner of the present invention, therefore, the magnetic powder dispersion-type carrier effectively traps the negative electric charge of the toner so as to be uniformly charged, and makes it possible to form a favorable image.

Besides, this magnetic carrier has such a property that the magnetic brush exhibits a magnetic force which is smaller than that of the conventional magnetic carrier. When combined with the CCA-less toner of the present invention to prepare the developing agent, therefore, limitation on the apparatus is greatly loosened since the magnetic force of the magnetic brush is small and a small torque is needed for carrying the magnetic brush, presenting a great advantage such as realizing the developing apparatus in a compact size. Moreover, the magnetic force of the magnetic brush is so small that the frictional force exerted by the magnetic brush on the surface of the photosensitive material is weak, too. The image obtained by using the above developing agent does not contain white stripes that is due to sweeping traces of the magnetic brush, and features excellent quality. For instance, when the content of the magnetic powder in the carrier becomes greater than the above range, the magnetic force of the magnetic brush becomes great and large stirring force is required for mixing and stirring the developing agent. Besides, the frictional force of the magnetic brush becomes large causing the image quality to become unsatisfactory. On the other hand, when the content of the magnetic powder in the carrier becomes smaller than the above range, the magnetic force of the magnetic brush becomes so small that it becomes difficult to effectively carry the developing agent in the form of a magnetic brush.

Unlike the magnetic powder dispersion-type magnetic carrier, the conventional magnetic carrier of which the surfaces are coated with a resin contains the magnetic component in large amounts. Besides, since the mean particle size is very small, the magnetic brush exhibits a large magnetic force presenting great disadvantage with respect to carrying the magnetic brush and slide friction.

Moreover, the magnetic powder dispersion-type carrier has a large mean particle size without containing fine powder, and has a small density. Therefore, a small stirring force is needed for mixing and stirring together with the toner, and the stirring for charging the toner is carried out under mild conditions. This magnetic carrier is obtained by dispersing the magnetic powder in the resin. The magnetic carrier having a large mean particle size is prevented from being aggregated together, and gives an advantage in that the developing utilizing the magnetic brush is stably carried out.

For instance, when the mean particle size of the magnetic carrier is smaller than the above-mentioned range, the density of the carrier increases since it contains fine powder. That is, a large stirring force is needed for mixing and stirring the magnetic carrier and the toner to electrically charge the toner, and strict limitation is imposed on the apparatus. Moreover, the surface areas of the carrier whose surfaces are made up of the resin increase, resulting in the aggregation of the carrier. When the mean particle sizes are larger than the above range, on the other hand, the surface areas of the carrier become small making it difficult to maintain a sufficiently large contact area with respect to the toner during the mixing and stirring for charging the toner. Accordingly, it becomes difficult to uniformly charge the toner by friction.

Moreover, since use is made of a high-resistance magnetic powder and a resin in an amount considerably greater than those of the conventionally known resin-coated carriers, adhesion onto the photosensitive material is effectively prevented despite the resistance of the magnetic carrier is decreased.

Resin Medium

In the dispersion-type magnetic carrier, the thermoplastic resin having a cationic polar group used as a dispersing medium for the magnetic powder is prepared by polymerizing, random-copolymerizing, block-copolymerizing or graft-copolymerizing a monomer that has a cationic polar group, or is a thermoplastic resin that is obtained by introducing a cationic polar group into a terminal of a polymer formed by using a cationic polar group-containing polymerization initiator, or is a resin composition of the above resin and another thermoplastic resin.

The cationic polar group may be any cationic group such as primary, secondary or tertiary amino group, or a basic nitrogen-containing group such as quaternary organoammonium group, amide group, imino group, imide group, hydrazino group, guanidino group or amidino group. Among them, the amino group or the quaternary ammonium group is particularly preferred.

Preferred examples of the monomer having a cationic polar group are as described below. Cationic polar group-containing vinyl monomer:

Diallyl dimethylammonium chloride, vinyltrimethylammonium chloride, N-vinyl carbazole, 2-vinyl imidazole, N-vinylpyrrole, N-vinylindole, N-vinylpyrrolidone, quaternary vinylpyridinium, etc. Basic nitrogen-containing (meth-)acrylic monomer:

Compounds represented by the following general formula (7),

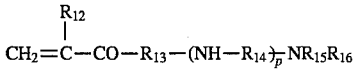

(7)

wherein $R_{12}$ is a hydrogen atom or a methyl group, $R_{13}$ and $R_{14}$ are each an alkylene group, $R_{15}$ and $R_{16}$ are each a hydrogen atom or an alkyl group, and p is zero or 1, or quaternary ammonium salts thereof.

Examples include a dimethylaminoethyl methacrylate, dimethylaminoethyl acrylate, diethylaminoethyl methacrylate, diethylaminoethyl acrylate, dimethylaminopropyl methacrylate, dimethylaminopropyl acrylate, dibutylaminoethyl methacrylate, dimethylaminopropyl methacrylamide, N,N-dimethylaminoethyl-N'-aminoethyl methacrylate, 3-acrylamide-3,3-dimethylpropyl dimethylamine, and quaternary ammonium salts thereof.

Furthermore, described below are suitable examples of the cationic polar group-containing polymerization initiator. Azoamidine or azoamide compounds:

Azoamidine or azoamide compounds represented by the following general formula (8),

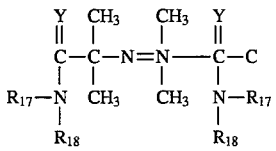

(8)

wherein Y is an oxygen atom or a group $=N-R_{19}$, wherein $R_{19}$ is a hydrogen atom or an alkyl group, $R_{17}$ is a hydrogen atom, a substituted or unsubstituted alkyl group, an alkenyl group or a substituted or unsubstituted aryl group, $R_{18}$ is a hydrogen atom or a substituted or unsubstituted alkyl group and, when the group Y is $=N-R_{19}$, the group $R_{19}$ and the group $R_{17}$ in combination may form a substituted or unsubstituted alkylene group.

Examples include:

2,2'-azobis(2-methyl-N-phenylpropionamidine)dihydrochlorate, 2,2'-azobis[N-(4-chlorophenyl)-2-methyl]propionamidine) dihydrochlorate, 2,2'-azobis[N-(4-hydroxyphenyl)-2-methyl] propionamidine) dihydrochlorate, 2,2'-azobis[N-(4-aminophenyl)-2-methyl] propionamidine) dihydrochlorate, 2,2'-azobis[2-methyl-N-(phenylmethyl)propionamidine) dihydrochlorate, 2,2'-azobis(2-methyl-N-propenylpropionamidine) dihydrochlorate, 2,2'-azobis(2-methylpropionamidine)dihydrochlorate, 2,2'-azobis[N-(2-hydroxyethyl)-2-methyl] propionamidine) dihydrochlorate, 2,2'-azobis[2-(5-methyl-2-imidazoline-2-il)propane] dihydrochlorate, 2,2'-azobis[2-(2-imidazoline-2-il)propane] dihydrochlorate, 2,2'-azobis[2-(4,5,6,-tetrahydro-1H-1,3-diazepine-2-il)propane] dihydrochlorate, 2,2'-azobis[2-(3,4,5,6-tetrahydropyrimidine-2-il)propane] dihydrochlorate, 2,2'-azobis[2-(5-hydroxy-3,4,5,6-tetrahydropyrimidine-2-il-)propane] dihydrochlorate, 2,2'-azobis{2-[1-(2-hydroxyethyl)-2-imidazoline-2-il)propane}dihydrochlorate, 2,2'-azobis[2-(2-imidazoline-2-il)propane], 2,2'-azobis{[2-methyl-N-[1,1-bis(hydroxymethyl)-2-hydroxyethyl] propionamide}}, 2,2'-azobis{2-methyl-N-[1,1-bis(hydroxymethyl)ethyl]propionamide}}, 2,2'-azobis{2-methyl-N-[2-hydroxyethyl] propionamide}}, 2,2'-azobis[2-methylpropionamide] dihydrate, etc.

Other monomers or thermoplastic resins that serve as chief components of the resin or the resin composition may be any monomers or thermoplastic resins that do not adversely affect the charging property of the carrier that stems from the cationic polar group. Generally, examples thereof may be one or two or more kinds of monomers having an ethylenically unsaturated bond or thermoplastic resins derived therefrom.

Examples of the monomer having an ethylenically unsaturated bond are those which are suitably used as resins for fixing the toner, such as acrylic monomer, monovinyl aromatic monomer, vinyl ester monomer, vinyl ether monomer, diolefin monomer, monoolefin monomer and the like.

According to the present invention, furthermore, the thermoplastic resin or the resin composition having the cationic polar group should have cationic polar groups at a concentration of 2 to 50 millimols and, particularly, 10 to 30 millimols per 100 g of the resin or the resin composition. When the concentration of the cationic polar group is smaller than the above range, it becomes difficult to impart electric charge to the magnetic carrier to supplement the electric charge of the CCA-less toner. When the cationic polar groups are contained at a concentration larger than the above range, on the other hand, the resin or the resin composition tends to be aggregated due to moisture and the like.

High-Resistance Magnetic Powder

As described earlier, the magnetic powder to be dispersed in the thermoplastic resin or the resin composition having cationic polar groups has a resistivity which is as high as not smaller than $1\times10^5$ Ω-cm and, particularly $10^6$ to $10^7$ Ω-cm.

A variety of magnetic powders can be used as exemplified as toner components in which magnetite is a representative example. They have resistivities which are smaller than $1\times10^5$ Ω-cm; e.g., tri-iron tetroxide (magnetite) has a resistivity of about $10^3$ Ω-cm. It is not therefore allowed to directly use these magnetic powders, and the resistivity must be adjusted to lie within the above-mentioned range by subjecting the surfaces to the oxidation treatment or by removing undesired irons. Ferrite which has heretofore been used as a magnetic carrier of the two-component-type magnetic developing agent has a high resistance and can be used without needing any particular treatment.

The above-mentioned magnetic powder may have been treated for its surfaces with, for example, a silane coupling agent or a titanium coupling agent to improve dispersion property in the resin so far as the resistivity lies within the above-mentioned range.

It is further desired that the magnetic powder has a mean particle size of usually not greater than 2 μm and, particularly, from 0.05 to 1.0 μm. When the mean particle size is larger than this range, it becomes difficult to adjust the mean particle size of the granular carrier obtained by dispersing the magnetic powder in the resin to lie within the above-mentioned range.

Preparation of the Magnetic Powder Dispersion-Type Carrier

The magnetic powder dispersion-type carrier is prepared by uniformly kneading the above-mentioned cationic group-containing thermoplastic resin or the resin composition and the high-resistance magnetic powder under the application of heat, and excluding the fine powder by pulverization and classification such that the mean particle sizes range from 50 to 150 μm and, particularly, from 70 to 120 μm.

[Formation of Image]

In carrying out the electrostatic photocopying by using the above-mentioned two-component-type magnetic developing agent comprising the CCA-less toner and the magnetic carrier, the electrostatic latent image can be formed by any method that has been known per se. For instance, after the photoconducting layer on the conductor substrate is uniformly charged, the electrostatic latent image is formed by exposing the image to light.

The electrostatic latent image can be easily developed by bringing the magnetic brush of the two-component-type developing agent into contact with the substrate. The toner image formed by developing is transferred onto a copying paper, and the toner image is brought into contact with a heated roll to fix it.

EXAMPLES

The invention will now be explained by way of Examples.

EXAMPLE 1

| (Toner composition) | (Parts by weight) |
|---|---|
| Resin for fixing (styrene-acrylic copolymer having carboxyl group, acid value; 10) | 100 |
| Coloring agent (carbon black) | 7 |
| Magnetic powder (magnetite) | 2 |

Here, the carbon black possessed a dispersion pH of 3.5, a BET specific surface area of 134 $m^2/g$ and a DBP oil-absorbing amount of 100 ml/100 g.

The above composition was melt-kneaded using a biaxial extruder, and the kneaded material was pulverized using a Jet mill, and was classified using a pneumatic classifier to obtain toner particles having an average mean particle size of 10.0 μm.

To the toner particles were added, as a fluidity-improving agent, hydrophobic fine particles having an average mean particle size of 0.015 μm in an amount of 0.3 parts by weight per 100 parts by weight of the toner particles, and the mixture was mixed together by using Henschel's mixer for two minutes to obtain a toner of the present invention.

EXAMPLE 2

A toner of the present invention was obtained in the same manner as in Example 1 with the exception of externally adding 0.5 parts by weight of acrylic resin particles having an average mean particle size of 0.15 μm as spacer particles.

EXAMPLE 3

A toner of the present invention was obtained in the same manner as in Example 1 with the exception of externally adding 0.5 parts by weight of magnetite particles having an average mean particle size of 0.4 μm as spacer particles.

EXAMPLE 4

A toner of the present invention was obtained in the same manner as in Example 1 with the exception of externally adding 0.5 parts by weight of magnetite particles having an average mean particle size of 0.4 μm and 0.5 pares by weight of zinc oxide particles having an average mean particle size of 0.3 μm as spacer particles.

Comparative Example 1

A toner was obtained in the same manner as in Example 1 with the exception of using as a resin for fixing, a styrene-acrylic copolymer without having carboxyl group in the resin.

Comparative Example 2

A toner was obtained in the same manner as in Example 1 but without internally adding magnetite.

Comparative Example 8

A toner was obtained in the same manner as in Example 1 but internally adding the magnetite to the toner in an amount of 10 parts by weight.

Comparative Example 4

A toner was obtained in the same manner as in Example 1 but adding an azo dyestuff (trade name: "S-34" produced by Orient Kagaku Co.) as a charge control agent.

Comparative Example 5

A toner was obtained in the same manner as in Example 1 but adding a salicylic acid derivative (trade name: "E-84" produced by Orient Kagaku Co.) as a charge control agent.

[Evaluation of Toner]

(1) Measurement of Absorbancy.

100 Milligrams of the toner was accurately weighed, introduced into a sampling bottle, 50 ml of methanol was added thereto, and the mixture was stirred using a ball mill for 10 minutes and was then left to stand for 15 hours. 20 Milliliters of the supernatant solution was subjected to the centrifuge and was used as a sample for measuring the absorbancy.

The absorbancy was measured by using a spectrophotometer "U-3210" manufactured by Hitachi, Ltd. Results of evaluation are shown in Table 1.

TABLE 1

| | Example | | | | Comparative Example | | | | |
|---|---|---|---|---|---|---|---|---|---|
| Toner composition (parts by wt.) | 1 | 2 | 3 | 4 | 1 | 2 | 3 | 4 | 5 |
| Fixing resin | | | | | | | | | |
| with carboxylic acid | 100 | 100 | 100 | 100 | — | 100 | 100 | 100 | 100 |
| without carboxylic acid | — | — | — | — | 100 | — | — | — | — |
| Coloring agent | | | | | | | | | |

TABLE 1-continued

| | Example | | | | Comparative Example | | | | |
|---|---|---|---|---|---|---|---|---|---|
| Toner composition (parts by wt.) | 1 | 2 | 3 | 4 | 1 | 2 | 3 | 4 | 5 |
| carbon black | 7 | 7 | 7 | 7 | 7 | 7 | 7 | 7 | 7 |
| Mag. powder | | | | | | | | | |
| magnetite | 2 | 2 | 2 | 2 | 2 | — | 10 | 2 | 2 |
| Charge control | | | | | | | | | |
| azo dye | — | — | — | — | — | — | — | 2 | — |
| salicylic acid derivative | — | — | — | — | — | — | — | — | 2 |
| Ext. added agent | | | | | | | | | |
| silica particles | 0.3 | 0.3 | 0.3 | 0.3 | 0.3 | 0.3 | 0.3 | 0.3 | 0.3 |
| acrylic resin particles | — | 0.5 | — | — | — | — | — | — | — |
| magnetite particles | — | — | 0.5 | 0.5 | — | — | — | — | — |
| zinc oxide particles | — | — | — | 0.5 | — | — | — | — | — |
| 400–700 nm | | | | | | | | | |
| Absorbancy | 0 | 0 | 0 | 0 | 0 | 0 | 0 | 0.15 | 0 |
| (Absorption peak (nm)) | | | | | | | | (550) | |
| 280–350 nm | | | | | | | | | |
| Absorption peak (nm) | none | none | none | none | none | none | none | none | 320 |
| Absorbancy | | | | | | | | | 0.52 |

(2) Test for Evaluation.

The toners obtained in the aforementioned Examples and Comparative Examples were blended with a ferrite carrier having an average mean particle size of 100 μm and were homogeneously mixed to prepare two-component-type developing agents having a toner concentration of 3.5%. Then, 100,000 pieces of copies were obtained by using an apparatus modified from an electrocopying machine (trade name "DC-7085") produced by Mira Kogyo Co.

A document for copying bore characters, the area of black portions thereof being 8%. The document for evaluating the image such as image density and the like, on the other hand, possessed the area of black portions inclusive of black solid portions of 15%.

The testing methods were as follows:

(a) Image Density (I.D.).

The density of a black solid portion in the copied image was measured after every predetermined number of pieces up to 100,000 pieces by using a reflection densitometer (model "TC-6D", manufactured by Tokyo Denshoku Co.).

(b) Fogging Density (F.D.)

The density of the non-image portion was measured by using a reflection densitometer (model "TC-6D", manufactured by Tokyo Denshoku Co.) and was expressed as a difference from a base paper (density of the paper of before being copied). The results of evaluation are shown in Table 2.

TABLE 2

| | Example | | | | Comparative Example | | | | |
|---|---|---|---|---|---|---|---|---|---|
| | 1 | 2 | 3 | 4 | 1 | 2 | 3 | 4 | 5 |
| I.D. | | | | | | | | | |
| when started | 1.335 | 1.375 | 1.376 | 1.390 | 1.312 | 1.350 | 1.050 | 1.336 | 1.328 |
| 20,000 pieces | 1.333 | 1.356 | 1.382 | 1.388 | 1.230 | 1.121 | 1.020 | 1.362 | 1.354 |
| 40,000 pieces | 1.342 | 1.368 | 1.378 | 1.383 | 1.150 | 1.051 | 1.002 | 1.366 | 1.382 |
| 60,000 pieces | 1.325 | 1.364 | 1.369 | 1.379 | 1.062 | 1.003 | 1.020 | 1.385 | 1.406 |
| 80,000 pieces | 1.335 | 1.372 | 1.374 | 1.388 | 1.002 | 0.925 | 0.951 | 1.408 | 1.435 |
| 100,000 pieces | 1.342 | 1.369 | 1.379 | 1.385 | 0.922 | 0.950 | 0.985 | 1.420 | 1.435 |
| F.D. | | | | | | | | | |
| when started | 0.001 | 0.001 | 0.001 | 0.001 | 0.002 | 0.003 | 0.003 | 0.002 | 0.003 |
| 20,000 pieces | 0.003 | 0.001 | 0.002 | 0.002 | 0.003 | 0.005 | 0.004 | 0.005 | 0.005 |
| 40,000 pieces | 0.003 | 0.000 | 0.003 | 0.001 | 0.002 | 0.003 | 0.005 | 0.004 | 0.007 |
| 60,000 pieces | 0.002 | 0.002 | 0.001 | 0.002 | 0.001 | 0.005 | 0.003 | 0.006 | 0.006 |
| 80,000 pieces | 0.004 | 0.002 | 0.002 | 0.002 | 0.002 | 0.008 | 0.005 | 0.012 | 0.011 |
| 100,000 pieces | 0.003 | 0.002 | 0.001 | 0.001 | 0.001 | 0.005 | 0.004 | 0.014 | 0.013 |
| Resolution (number of line/mm) | | | | | | | | | |
| when started | 5.0 | 5.6 | 5.0 | 5.0 | 5.0 | 5.0 | 3.6 | 5.0 | 4.5 |
| 20,000 pieces | 5.6 | 5.6 | 5.0 | 5.6 | 5.6 | 5.0 | 3.6 | 4.5 | 4.0 |
| 40,000 pieces | 5.6 | 5.0 | 5.6 | 5.0 | 5.0 | 4.5 | 3.6 | 4.5 | 4.0 |
| 60,000 pieces | 5.6 | 5.6 | 5.0 | 5.6 | 5.6 | 5.0 | 3.6 | 4.0 | 3.6 |
| 80,000 pieces | 5.0 | 5.0 | 5.0 | 5.0 | 5.0 | 5.0 | 3.2 | 4.0 | 3.2 |

TABLE 2-continued

| | Example | | | | Comparative Example | | | | |
|---|---|---|---|---|---|---|---|---|---|
| | 1 | 2 | 3 | 4 | 1 | 2 | 3 | 4 | 5 |
| 100,000 pieces | 5.6 | 5.6 | 5.0 | 5.6 | 5.6 | 5.0 | 3.6 | 3.6 | 3.6 |
| Transfer efficiency | | | | | | | | | |
| start to 20,000 pieces | 82.5 | 85.6 | 86.8 | 86.2 | 78.3 | 68.2 | 83.5 | 85.6 | 84.2 |
| 20,000 to 40,000 pieces | 81.5 | 84.3 | 86.7 | 87.2 | 70.6 | 63.5 | 82.5 | 80.5 | 75.9 |
| 40,000 to 60,000 pieces | 80.3 | 85.3 | 86.2 | 86.9 | 68.5 | 56.9 | 83.2 | 74.9 | 66.1 |
| 60,000 to 80,000 pieces | 81.5 | 85.0 | 86.3 | 86.9 | 65.8 | 52.8 | 81.5 | 65.9 | 59.9 |
| 80,000 to 100,000 pieces | 81.5 | 85.2 | 86.5 | 87.1 | 63.6 | 50.9 | 80.9 | 53.8 | 53.7 |
| Scattering of toner | ○ | ○ | ○ | ○ | ○ | X | ○ | X | X |

(c) Resolution

Copies were obtained by using a document bearing a predetermined chart, and the number of lines was counted on a copied image using a microdensitometer in regard to those having a peak value of not smaller than 0.8, a ground value of not smaller than 0.4, and a difference between the peak value and the ground value of not smaller than 0.6. The results of evaluation were as shown in Table 2.

Transfer Efficiency

The amount of toner in the toner hopper of prior to starting the copying and the amount of toner in the toner hopper after a predetermined number of pieces were copied were measured, and the consumption of toner was calculated from the difference. At the same time, the amount of toner recovered in the step of cleaning while the predetermined number of copies were obtained, was measured to find the amount of toner recovered. From these values, the toner transfer efficiency was calculated in compliance with the following formula after every 20,000 pieces of copies. The results of evaluation were as shown in Table 2.

Transfer efficiency (%)=(Amount of toner consumed) −(Amount of toner recovered)/(Amount of toner consumed) ×100

(e) Scattering of toner

The scattered state of toner in the copying machine after 100,000 pieces of copies were obtained was observed by naked eyes, and was evaluated on the following basis. The results of evaluation were as shown in Table 2.

○: Toner did not scatter.

X: Toner scattered.

(f) Amount of spent

The developing agent sampled every after a predetermined number of pieces was placed on a sieve of 400 mesh, and was attracted from the lower direction by using a blower to separate it into the toner and the carrier. 5 Grams of the carrier left on the sieve was introduced into a beaker followed by the addition of toluene, so that the toner adhered on the surfaces of the carrier was dissolved. Then, the toluene solution was discarded away in a state where the carrier was attracted by a magnet from the lower side of the beaker. This operation was repeated several times until the toluene became colorless. The toluene was then dried in an oven to measure the weight. A difference between the weight contained in the beaker and the weight after drying is the amount of spent. The amount of spent was expressed in terms of milligrams of the spent toner adhered per one gram of the carrier. The results of evaluation were as shown in Table 3.

(g) Amount of electric charge of the toner

200 Milligrams of the developing agent was measured by an ordinary method using a "Blow-Off Powder Charge Measuring Device" produced by Toshiba Chemical Co., and was expressed in terms of the amount of electric charge per one gram of the toner. The results of evaluation were as shown in Table 3.

(h) Electric resistance of the developing agent

200 Milligrams of the developing agent was introduced into a measuring jig with an electrode gap of 2 mm, and a bridge of the developing agent was formed across the electrodes by bringing magnets of 1500 gausses from both sides thereof. A voltage of 1000 V was applied across the electrodes, and the electric resistance was calculated from an electric current that flew between the electrodes. The results of evaluation were as shown in Table 3.

TABLE 3

| | Example | | | | Comparative Example | | | | |
|---|---|---|---|---|---|---|---|---|---|
| | 1 | 2 | 3 | 4 | 1 | 2 | 3 | 4 | 5 |
| Amount of spent (mg) | | | | | | | | | |
| when started | 0 | 0 | 0 | 0 | 0 | 0 | 0 | 0 | 0 |
| 20,000 pieces | 0.05 | 0.04 | 0.04 | 0.04 | 0.06 | 0.06 | 0.04 | 0.25 | 0.31 |
| 40,000 pieces | 0.12 | 0.09 | 0.07 | 0.06 | 0.14 | 0.13 | 0.09 | 0.52 | 0.62 |
| 60,000 pieces | 0.16 | 0.13 | 0.11 | 0.09 | 0.18 | 0.18 | 0.12 | 0.79 | 0.95 |
| 80,000 pieces | 0.22 | 0.18 | 0.15 | 0.12 | 0.23 | 0.23 | 0.18 | 0.92 | 1.20 |
| 100,000 pieces | 0.28 | 0.22 | 0.19 | 0.14 | 0.29 | 0.28 | 0.23 | 1.21 | 1.62 |
| Amount of electric charge (μC/g) | | | | | | | | | |
| when started | −18.9 | −16.9 | −16.8 | −17.2 | −19.6 | −17.4 | −16.8 | −24.5 | −25.6 |
| 20,000 pieces | −22.3 | −18.5 | −17.5 | −18.3 | −24.3 | −25.9 | −18.9 | −26.9 | −22.3 |
| 40,000 pieces | −21.9 | −18.6 | −17.2 | −19.2 | −26.5 | −31.6 | −17.9 | −23.5 | −18.9 |
| 60,000 pieces | −23.5 | −19.5 | −18.2 | −18.8 | −27.3 | −34.6 | −18.6 | −19.5 | −15.8 |

TABLE 3-continued

| | Example | | | | Comparative Example | | | | |
|---|---|---|---|---|---|---|---|---|---|
| | 1 | 2 | 3 | 4 | 1 | 2 | 3 | 4 | 5 |
| 80,000 pieces | −22.6 | −18.2 | −17.3 | −19.2 | −31.6 | −37.8 | −18.4 | −13.5 | −13.5 |
| 100,000 pieces | −22.5 | −18.6 | −17.6 | −19.0 | −33.5 | −39.8 | −18.8 | −11.6 | −10.9 |
| Electric resistance of the developing agent | $8 \times 10^9$ | $7 \times 10^9$ | $9 \times 10^9$ | $8 \times 10^9$ | $8 \times 10^9$ | $3 \times 10^9$ | $4 \times 10^{12}$ | $7 \times 10^9$ | $7 \times 10^9$ |

(3) Consideration of the Results of Evaluation

Examples 1 to 3 exhibited very stable image density, fogging, resolution and transfer efficiency and favorable toner scattering.

According to Comparative Example 1 using a resin without anionic group, on the other hand, the amount of electric charge greatly increased with an increase in the number of copies, resulting in a decrease in the image density and in the transfer efficiency.

Even in Comparative Example 2 without containing magnetic powder, the amount of electric charge greatly increased, and the image density and the transfer efficiency were deteriorated. In addition, the scattering of toner increased progressively with an increase in the number of copies.

In the case of Comparative Example 3 using the magnetic powder in large amounts, the amount of electric charge did not increase but the image density was on a low level from the start. The resolution greatly decreased, too. This was due to that the caring state of the developing agent was too strong or the electric resistance of the developing agent was very high.

In the cases of Comparative Examples 4 and 5 using a charge control agent, the amount of charge of the toner decreased with an increase in the number of copies, the fogging increased, and the transfer efficiency decreased. The decrease in the amount of charge of the toner is attributed to that the toner was spent in large amounts.

Application Example 1

In the following experiments, the additives blended into the toner were examined for their effects upon the image properties.

Experiments Nos. 1 to 12

Toners were prepared in the same manner as in Example 3 with the exception of changing the kinds of carbon blacks and the amounts thereof as shown in Table 4 and using magnetite having a mean particle size of 0.3 μm as spacer particles.

By using these toners, the image density, fogging and transfer efficiency were evaluated in compliance with the methods described above. The results were as shown in Table 4.

TABLE 4

| | Experimental Examples | | | | | | | | | | | |
|---|---|---|---|---|---|---|---|---|---|---|---|---|
| | 1 | 2 | 3 | 4 | 5 | 6 | 7 | 8 | 9 | 10 | 11 | 12 |
| Carbon black content (wt %) | 7 | 4 | 15 | 7 | 7 | 7 | 7 | 7 | 7 | 7 | 7 | 7 |
| pH | 3.5 | 3.5 | 3.5 | 2.5 | 4 | 3.5 | 6.0 | 8.0 | 8.0 | 2.5 | 4.0 | 7.0 |
| BET specific surface area ($m^2/g$) | 134 | 134 | 134 | 138 | 96 | 190 | 120 | 127 | 127 | 560 | 65 | 220 |
| DBP oil-absorbing amount (ml/100 g) | 100 | 100 | 100 | 60 | 72 | 100 | 70 | 45 | 70 | 100 | 42 | 115 |
| Image density | | | | | | | | | | | | |
| when started | 1.380 | 1.325 | 1.485 | 1.365 | 1.345 | 1.360 | 1.365 | 1.341 | 1.305 | 1.345 | 1.338 | 1.329 |
| 10,000 pieces | 1.351 | 1.315 | 1.457 | 1.332 | 1.325 | 1.352 | 1.328 | 1.221 | 1.235 | 1.303 | 1.298 | 1.305 |
| 20,000 pieces | 1.331 | 1.309 | 1.466 | 1.312 | 1.301 | 1.339 | 1.335 | 1.201 | 1.202 | 1.281 | 1.275 | 1.299 |
| 30,000 pieces | 1.325 | 1.303 | 1.458 | 1.298 | 1.311 | 1.319 | 1.330 | 1.203 | 1.188 | 1.204 | 1.222 | 1.285 |
| 40,000 pieces | 1.321 | 1.301 | 1.447 | 1.302 | 1.312 | 1.328 | 1.341 | 1.210 | 1.192 | 1.158 | 1.189 | 1.291 |
| Fogging | | | | | | | | | | | | |
| when started | 0.002 | 0.002 | 0.003 | 0.003 | 0.003 | 0.002 | 0.003 | 0.006 | 0.005 | 0.007 | 0.004 | 0.005 |
| 10,000 pieces | 0.001 | 0.002 | 0.002 | 0.002 | 0.003 | 0.002 | 0.002 | 0.006 | 0.004 | 0.005 | 0.004 | 0.004 |
| 20,000 pieces | 0.000 | 0.002 | 0.002 | 0.001 | 0.002 | 0.002 | 0.001 | 0.005 | 0.006 | 0.007 | 0.004 | 0.005 |
| 30,000 pieces | 0.000 | 0.001 | 0.003 | 0.002 | 0.002 | 0.003 | 0.002 | 0.007 | 0.005 | 0.009 | 0.004 | 0.006 |
| 40,000 pieces | 0.000 | 0.001 | 0.003 | 0.002 | 0.002 | 0.001 | 0.003 | 0.008 | 0.005 | 0.009 | 0.005 | 0.007 |
| Transfer efficiency (%) (a total of 40,000 pieces) | 87.8 | 88.2 | 86.3 | 84.5 | 85.8 | 87.2 | 85.9 | 68.5 | 69.6 | 56.0 | 83.2 | 66.1 |

Experiments Nos. 13 to 20

100,000 pieces of copies were obtained to evaluate the scattering of toner and fixing property in compliance with the methods mentioned above by using toners prepared in the same manner as in Example 1 except that polyester resins having weight average molecular weights (Mw) shown in Table 5 were further used in amounts shown in Table 5.

Evaluation of Fixing Property:

A uniformly stretched bleached cotton was stuck to the bottom of a weight of 400 g having a flat bottom surface, and the black solid portion of the image was rubbed with this weight at a constant speed five round trips. ID of before rubbing and ID of after rubbing S were measured, and the peeling rate was found as a fixing rate.

Fixing rate (%)=(ID after rubbing)/(ID before rubbing)×100

The fixing rates are shown in FIG. 5 on the following basis.

○: not smaller than 90%

Δ: not smaller than 80% but smaller than 90%

X: smaller than 80%

TABLE 5

| | Experiment No. | | | | | | | |
|---|---|---|---|---|---|---|---|---|
| | 13 | 14 | 15 | 16 | 17 | 18 | 19 | 20 |
| Polyester Mn | 2,000 | 2,000 | 500 | 10,000 | — | 2,000 | 400 | 12,000 |
| Blending amount (parts by weight) | 5 | 20 | 5 | 5 | 0 | 25 | 5 | 5 |
| Fixing rate | ○ | ○ | ○ | ○ | Δ | ○ | ○ | X |
| Scattering of toner | ○ | ○ | ○ | ○ | ○ | X | X | ○ |

It will be understood from the above results, that the toners blended with polyester resins having weight average molecular weights within a predetermined range in suitable amounts, exhibit improved fixing rates and decreased toner scattering.

Experiments Nos. 21 to 28

100,000 pieces of copies were obtained to evaluate the scattering of toner and fixing property in compliance with the methods mentioned above by using toners prepared in the same manner as in Example 1 except that polyethylenes having number average molecular weights (Mn) shown in Table 6 were further used in amounts shown in Table 6. The results were as shown in Table 6.

TABLE 6

| | Experiment No. | | | | | | | |
|---|---|---|---|---|---|---|---|---|
| | 21 | 22 | 23 | 24 | 25 | 26 | 27 | 28 |
| polyethylene Mn | 4,000 | 4,000 | 1,000 | 5,000 | — | 4,000 | 800 | 7,000 |
| Blending amount (parts by weight) | 2 | 5 | 2 | 2 | 0 | 7 | 2 | 2 |
| Fixing rate | ○ | ○ | ○ | ○ | Δ | ○ | ○ | X |
| Scattering of toner | ○ | ○ | ○ | ○ | ○ | X | X | ○ |

It will be understood from the above results, that the toners blended with polyethylene resins having nember average molecular weights within a predetermined range in suitable amounts, exhibit improved fixing rates and decreased toner scattering.

Application Example 2

In the following experimental examples, effects upon the image were examined in the case where a magnetic powder dispersion-type carrier was used.

Experiment No. 29

| Preparation of carrier (carrier composition) | |
|---|---|
| Resin (amino group-containing styrene-acrylic copolymer) | 100 parts by weight |
| Magnetic powder (magnetite, | 400 parts by weight |

-continued

| Preparation of carrier (carrier composition) | |
|---|---|
| specific resistivity: $2.0 \times 10^5$ Ω-cm) | |
| Coloring agent (carbon black, Printex L) | 5 parts by weight |

The above composition was melt-kneaded using a biaxial extruder, and the kneaded material was pulverized using a PJM ultrasonic Jet pulverizer, and was classified pneumatically and by using a sieve to obtain a carrier A having an average mean particle size of 80.5 μm.

Evaluation of the Developing Agent:

The carrier A was added to the toner prepared in Example 1 and was homogeneously mixed to prepare a two-component-type developing agent having a toner concentration of 5%.

By using this developing agent, 50,000 pieces of copies were obtained by the method described earlier to evaluate the image density, fogging density and transfer efficiency. After a predetermined number of pieces were copied, furthermore, the copied image was visually observed to evaluate the adhesion of carrier to the image portion on the following basis.

○: No carrier adhered.

Δ:Carrier adhered in small amounts

X: Carrier adhered in large amounts

Results of evaluation are shown in Tables 7 and 8.

Experiment No. 30

A carrier B having an average mean particle size of 130.2 μm was obtained in the same manner as when the carrier A was obtained with the exception of using 250 parts of magnetite having a resistivity of $1.5\times10^7$ Ω-cm instead of the magnetic powder (magnetite) that was used for the carrier A.

The carrier B was added to the toner of Example 1, and was homogeneously mixed to prepare & two-component-type developing agent having a toner concentration of 3.54 by weight. The developing agent was evaluated in the same manner as in Experiment No. 29. The results were as shown in Tables 7 and 8.

Experiment No. 31

A carrier C having an average mean particle size of 50.7 μm was obtained in the same manner as when the carrier A was obtained with the exception of using 100 parts by weight of a styrene-acrylic copolymer and 3 parts by weight of a styrene-acrylic copolymer containing a quaternary ammonium salt instead of the resin (amino group-containing styrene-acrylic copolymer) of the carrier A.

The carrier C was added to the toner of Example 1 and was homogeneously mixed to prepare a two-component-type developing agent having a toner concentration of 8% by weight. This developing agent was evaluated in the same manner as in Experiment No. 29. The results were as shown in Tables 7 and 8.

Experiment No. 32

A carrier D having an average mean particle size of 85.1 μm was obtained in the same manner as when the carrier A was obtained with the exception of using 400 parts by weight of magnetite having a resistivity of $7.5 \times10^3$ Ω-cm instead of the magnetic powder (magnetite) that was used For the carrier A.

The carrier D was added to the toner of Example 1, and was homogeneously mixed to prepare a two-component-type developing agent having a toner concentration of 5% by weight. This developing agent was evaluated in the same manner as in Experiment No. 29. The results were as shown in Tables 7 and 8.

Experiment No. 33

A carrier E having an average mean particle size of 78.8 μm was obtained in the same manner as when the carrier A was obtained but changing the amount of the magnetic powder (magnetite) to 120 parts by weight.

The carrier E was added to the toner of Example 1, and was homogeneously mixed to prepare a two-component-type developing agent having a toner concentration of 5% by weight. This developing agent was evaluated in the same manner as in Experiment No. 29. The results were as shown in Tables 7 and 8.

Experiment No, 34

A carrier F having an average mean particle size of 83.6 μm was obtained in the same manner as when the carrier A was obtained but changing the amount of the magnetic powder (magnetite) to 800 parts by weight.

The carrier F was added to the toner of Example 1, and was homogeneously mixed to prepare a two-component-type developing agent having a toner concentration of 5% by weight.

Experiment No. 35

A toner having an average mean particle size of 10.8 μm was obtained in the same manner as in Example 1 but adding, as a charge control agent, an azo dyestuff S-34 (produced by Orient Kagaku Co.) in an amount of 1.5 parts by weight.

The carrier A was added to this toner and was homogeneously mixed to prepare a two-component-type developing agent having a toner concentration of 5% by weight. This developing agent was evaluated in the same manner as in Experiment No. 29. The results were as shown in Tables 7 and 8.

TABLE 7

| | | Experiment No. | | | | | | |
|---|---|---|---|---|---|---|---|---|
| | | 29 | 30 | 31 | 32 | 33 | 34 | 35 |
| I.D. | when started | 1.366 | 1.356 | 1.353 | 1.312 | 1.321 | 1.270 | 1.322 |
| | 10,000 pieces | 1.350 | 1.366 | 1.343 | 1.304 | 1.300 | 1.288 | 1.304 |
| | 20,000 pieces | 1.356 | 1.370 | 1.311 | 1.280 | 1.289 | 1.233 | 1.300 |

TABLE 7-continued

| | | Experiment No. | | | | | | |
|---|---|---|---|---|---|---|---|---|
| | | 29 | 30 | 31 | 32 | 33 | 34 | 35 |
| | 30,000 pieces | 1.365 | 1.365 | 1.333 | 1.290 | 1.312 | 1.239 | 1.316 |
| | 40,000 pieces | 1.352 | 1.355 | 1.309 | 1.278 | 1.295 | 1.165 | 1.302 |
| | 50,000 pieces | 1.360 | 1.353 | 1.314 | 1.277 | 1.288 | 1.221 | 1.308 |
| F.D. | when started | 0.002 | 0.002 | 0.002 | 0.003 | 0.004 | 0.003 | 0.002 |
| | 10,000 pieces | 0.003 | 0.003 | 0.003 | 0.003 | 0.003 | 0.003 | 0.003 |
| | 20,000 pieces | 0.003 | 0.002 | 0.001 | 0.004 | 0.004 | 0.004 | 0.004 |
| | 30,000 pieces | 0.004 | 0.004 | 0.002 | 0.005 | 0.004 | 0.005 | 0.003 |
| | 40,000 pieces | 0.002 | 0.003 | 0.002 | 0.004 | 0.004 | 0.006 | 0.004 |
| | 50,000 pieces | 0.004 | 0.003 | 0.003 | 0.004 | 0.005 | 0.007 | 0.005 |

TABLE 8

| | Experiment No. | | | | | | |
|---|---|---|---|---|---|---|---|
| | 29 | 30 | 31 | 32 | 33 | 34 | 35 |
| Transfer efficiecy | | | | | | | |
| 0 to 10,000 pieces | 82.6% | 81.2% | 78.5% | 73.2% | 77.3% | 73.3% | 79.2% |
| 10,000 to 20,000 pieces | 81.1% | 82.3% | 80.2% | 72.2% | 76.1% | 75.3% | 77.2% |
| 20,000 to 30,000 pieces | 82.0% | 83.0% | 79.1% | 71.8% | 72.5% | 72.5% | 76.6% |
| 30,000 to 40,000 pieces | 82.1% | 82.4% | 80.8% | 68.3% | 75.8% | 75.8% | 75.4% |
| 40,000 to 50,000 pieces | 80.9% | 81.9% | 78.9% | 71.1% | 69.0% | 69.0% | 73.1% |
| Adhesion of carrier | | | | | | | |
| when started | ○ | ○ | ○ | X | X | ○ | ○ |
| 10,000 pieces | ○ | ○ | ○ | X | X | Δ | ○ |
| 20,000 pieces | ○ | ○ | ○ | X | X | Δ | ○ |
| 30,000 pieces | ○ | ○ | ○ | X | X | Δ | ○ |
| 40,000 pieces | ○ | ○ | ○ | X | X | X | ○ |
| 50,000 pieces | ○ | ○ | ○ | X | X | X | ○ |
| Scattering of toner | ○ | ○ | ○ | ○ | ○ | ○ | ○ |

In Examples 29 to 31 and 35, the image density, fogging and transfer efficiency were stable, and the scattering of toner and adhesion of carrier onto the image portion had been effectively suppressed.

According to Experiment No. 32 which has employed a low-resistance magnetic powder, on the other hand, the carrier adhered in large amounts onto the image portion. According to Experiment No. 33 which has employed the magnetic powder In a small amount, the force for locking the carrier was weak on the developing sleeve, and the carrier adhered in large amounts onto the image portion.

According to Experiment No. 34, the amount of carrier adhered to the image portion increased with an increase in the number of pieces of copies presumably due to the fact that the carrier was so brittle that it cracked gradually.

It will be understood from the foregoing results that the magnetic powder dispersion-type carrier of the present invention is very effective as a carrier for the CCA-less toner. It will further be understood from the results of Experiment No. 35 that the carrier can also be used together with an ordinary toner in which the charge control agent is blended.

We claim:

1. A negatively-charged toner for a two-component-type magnetic developing agent having excellent spent resistance, comprising a resin medium for fixing which is a copolymer resin or a resin composition having anionic polar groups bonded to the resin skeleton and dispersed therein a magnetic powder in an amount of from 0.1 to 5 parts by weight per 100 parts by weight of said resin medium, and wherein an extract from which said toner is extracted with methanol exhibits absorbencies which are substantially zero at absorption peaks over wavelengths of from 400 to 700 nm and from 280 to 350 nm.

2. A toner according to claim 1, wherein said toner has a mean particle size of from 5 to 15 μm on the basis of volume, and further comprises a fine powdery fluidity-improving agent adhered onto the surfaces of the toner particles, said fine powdery fluidity-improving agent containing spacer particles having mean particle sizes of from 0.05 to 1.0 μm on the basis of volume.

3. A toner according to claim 2, wherein said spacer particles comprise a magnetite or a zinc oxide.

4. A toner according to claim 1, wherein said anionic polar group is a carboxylic acid group.

5. A toner according to claim 4, wherein the resin medium for fixing containing said anionic group has an acid value of from 2 to 30.

6. A toner according to claim 1, wherein said magnetic powder is a magnetite having a mean particle size of from 0.05 to 1.0 μm.

7. A toner according to claim 1, wherein said toner further comprising carbon black having a dispersion pH of smaller than 7, a BET specific surface area of from 90 to 200 $m^2/g$ and a DBP oil-absorbing amount of not smaller than 50 ml/100 g.

8. A toner according to claim 7, wherein said carbon black is contained in an amount of from 2 to 15 parts by weight per 100 parts by weight of the resin medium for fixing.

9. A toner according to claim 1, wherein said toner further comprises, as a fixing property-improving agent, a polyester resin having a weight average molecular weight of from 500 to 10,000 in an amount of from 0.5 to 20 parts by weight per 100 parts by weight of the resin medium for fixing.

10. A toner according to claim 1, wherein said toner further comprises, as a fixing property-improving agent, a polyethylene resin having a number average molecular weight of from 1000 to 5000 in an amount of from 0.5 to 5 parts by weight per 100 parts by weight of the resin medium for fixing.

11. A two-component-type magnetic developing agent comprising a mixture of a toner according to claim 1, and a magnetic carrier, wherein said magnetic carrier is a granular carrier having a mean particle size of from 50 to 150 μm and comprises a dispersion of a high-resistance magnetic powder having a resistivity of not smaller than $1\times10^5$ Ω-cm in an amount of 60 to 88% by weight in a thermoplastic resin or a resin composition having cationic polar groups.

12. A developing agent according to claim 11, wherein said cationic polar group is an amino group or a quaternary ammonium group.

13. A developing agent according to claim 11, wherein said cationic polar group is contained in an amount of from 2 to 50 millimols per 100 g of the thermoplastic resin or resin composition.

14. A magnetic carrier for a two-component-type magnetic developing agent, comprising a granular carrier having a mean particle size of from 50 to 150 μm which is a dispersion of a high-resistance magnetic powder having resistivity of not smaller than $1\times10^5$ Ω-cm in an amount of from 60 to 88% by weight in a thermoplastic resin or a resin composition having cationic polar groups.

15. A charge-controlling agent-free negatively-chargeable toner having improved spent resistance when used for a two-component-type magnetic developing agent, said toner comprising a charge-controlling fixing resin medium having dispersed therein from 0.1 to 5 parts by weight of magnetic powder, wherein said charge-controlling fixing resin medium comprises a copolymer resin comprising recurring units of ethylenically unsaturated monomer providing a fixing property to said resin and recurring units of monomer having anionic polar group providing a charge controlling property to said resin, and wherein as a result of not containing a charge controlling agent blended therewith, when said toner is extracted with methanol the resulting extract exhibits substantially zero absorbency at absorption peaks over wavelengths of from 400 to 700 nm and from 280 to 350 nm.

16. The toner of claim 15 wherein said charge-controlling fixing resin comprises a random, graft or block copolymer of a monomer having anionic polar group wherein the anionic polar group is a carboxylic acid, sulfonic acid or phosphonic acid, or a salt thereof, and at least one co-monomer having an ethylenically unsaturated bond, said comonomer being selected from the group consisting of acrylic monomers, monovinyl aromatic monomers, vinyl ether monomers, vinyl ester monomers, diolefin monomers, monoolefin monomer and mixtures thereof, and wherein the concentration of anionic polar groups in said copolymer resin is from 2 to 30, in terms of acid value, measured as free acid.

17. The toner of claim 15 wherein the charge-controlling fixing resin comprises a styrene-acrylic acid copolymer, said resin having an acid value of from 2 to 30.

18. The toner of claim 15 wherein from 0.5 to 3.0 parts by weight of magnetic powder is dispersed in 100 parts by weight of said charge-controlling fixing resin.

19. The two-component-type magnetic developing agent of claim 11 wherein the mixing ratio, on a weight basis, of the magnetic carrier to the toner is in the range of from 98:2 to 90:10.

20. The magnetic carrier according to claim 14 wherein the magnetic powder has a resistivity of from $10^6$ to $10^7$ Ω-cm, and is present in an amount of from 70 to 85% by weight of the carrier.

21. The magnetic carrier according to claim 14 having a mean particle size of from 70 to 120 μm.

* * * * *